US006730470B2

(12) United States Patent
Katoh

(10) Patent No.: US 6,730,470 B2
(45) Date of Patent: May 4, 2004

(54) PHOTOTHERMOGRAPHIC MATERIAL

(75) Inventor: Kazunobu Katoh, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/955,029

(22) Filed: Sep. 19, 2001

(65) Prior Publication Data

US 2002/0086251 A1 Jul. 4, 2002

(30) Foreign Application Priority Data

Sep. 19, 2000 (JP) ..... 2000-283731

(51) Int. Cl.[7] ..... G03C 1/498; G03C 1/31; G03C 1/34

(52) U.S. Cl. ..... 430/619; 264/531; 264/607; 264/631

(58) Field of Search ..... 430/619, 531, 430/264, 607, 631

(56) References Cited

U.S. PATENT DOCUMENTS 3,347,675 A 10/1967 Henn et al.
3,438,776 A 4/1969 Yudelson
3,666,477 A 5/1972 Goffe
3,667,959 A 6/1972 Bojara et al.
4,948,698 A * 8/1990 Komamura ..... 430/203
5,945,263 A * 8/1999 Deroover et al. ..... 430/350
6,280,923 B1 * 8/2001 Uytterhoeven et al. ..... 430/619

FOREIGN PATENT DOCUMENTS

EP 0803764 * 10/1997 ..... G03C/1/498

* cited by examiner

*Primary Examiner*—Thorl Chea
(74) *Attorney, Agent, or Firm*—Birch, Stewart, Kolasch & Birch, LLP

(57) ABSTRACT

A photothermographic material comprising at least (a) a photosensitive silver halide, (b) a silver salt of an organic acid, (c) a reducing agent and (d) a hydrophobic and thermoplastic organic binder on a support, which contains a heat-fusible solvent that is solid at an ordinary temperature and can be fused at a heat development temperature. There is provided a photothermographic material showing high sensitivity, high developing speed and little performance fluctuation due to variation of heat development temperature.

22 Claims, No Drawings

PHOTOTHERMOGRAPHIC MATERIAL

TECHNICAL FIELD

The present invention relates to a photothermographic material, in particular, a novel photothermographic material showing high sensitivity, high developing speed and little performance fluctuation due to variation of heat development temperature.

RELATED ART

A large number of photosensitive materials are known which have a photosensitive layer on a support and form images by exposing imagewise. As an example of a system that contributes to environmental protection or enables simplification of image formation means, there is a technique of forming an image by heat development.

Methods for forming images by heat development are described in, for example, U.S. Pat. Nos. 3,152,904, 3,457,075 and D. Klosterboer, Imaging Processes and Materials, "Thermally Processed Silver Systems" A, 8th ed., Chapter 9, page 279, compiled by J. Sturge, V. Walworth and A. Shepp, Neblette (1989). Such a photothermographic material contains a reducible non-photosensitive silver source (e.g., silver salt of an organic acid), a photocatalyst (e.g., silver halide) in a catalytically active amount, and a reducing agent for silver, which are usually dispersed in an organic binder matrix. The photosensitive material is stable at an ambient temperature, but when the material is heated at a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced by the reaction of the reducible silver salt in the exposed region shows black color and this presents a contrast to the non-exposed region to form an image.

Density of images to be formed is controlled by heat development temperature and time. However, since the image density is influenced by heating methods and means, development characteristics of photothermographic material and so forth, uniform images of a certain level are not always obtained. For this reason, it has been one of major problems of photothermographic materials that uneven density is more likely to be caused compared with the case where a material is immersed into a development solution at a constant temperature like in the wet type development. To solve this problem, it is effective to use a sufficient development temperature and take sufficient time until the image formation is saturated. However, when a sufficient development temperature and sufficient time are used, there is caused problems of degradation of quality such as increase of fog and change of silver color tone and reduction of productivity such as decrease of developing speed.

There has been proposed use of a highly active reducing agent as a development enhancer in order to increase the speed of the heat development treatment. For example, Japanese Patent Laid-open Publication (Kokai, hereinafter referred to as JP-A) 10-221806 discloses use of hindered phenol compounds and bisphenol compounds as a reducing agent and use of sulfonamidophenol compounds as a development enhancer. The development enhancer used in this case is a reducing agent showing higher activity than the main reducing agent, and it can accelerate advance of development in an early stage of development. However, since use of such a development enhancer in a larger amount relative to the main reducing agent causes problems such as fog, it can actually be used only in a limited amount. Therefore, its effect is also limited.

Meanwhile, JP-A-58-198038 and JP-A-58-229556 disclose photothermographic materials using a heat-fusible solvent with the aid of a hydrophilic binder such as gelatin as a binder. As the heat-fusible solvent, these patent documents disclose urea derivatives, amide derivatives, polyethylene glycols and polyhydric alcohols.

However, these photothermographic materials suffer from bad storability before light exposure. Therefore, sensitivity is decreased and fog is increased during storage. Furthermore, they also suffer from a problem of significant fluctuation of developing speed due to change of humidity in an environment for heat development. For example, under high humidity, the developing speed becomes high, whereas it will be lowered under low humidity.

SUMMARY OF THE INVENTION

In view of the aforementioned problems of the prior art, an object of the present invention is to provide a photothermographic material showing high sensitivity, high developing speed and little performance fluctuation due to variation of heat development temperature.

The inventors of the present invention assiduously studied in order to achieve the aforementioned object. As a result, they found that a photothermographic material providing the desired effects can be obtained by adding a heat-fusible solvent that is solid at an ordinary temperature and can be fused at a heat development temperature to a photothermographic material comprising at least (a) a photosensitive silver halide, (b) a silver salt of an organic acid, (c) a reducing agent and (d) a hydrophobic and thermoplastic organic binder on a support, and thus accomplished the present invention.

The photothermographic material of the present invention preferably further contains a halogen-releasing precursor and/or an ultrahigh contrast agent. Further, the photothermographic material of the present invention is preferably produced through a step of coating and drying a coating solution containing latex dispersed in water as the organic binder. Furthermore, the photothermographic material of the present invention is preferably produced through a step of coating and drying a coating solution containing microparticles of the reducing agent solid-dispersed in water and/or microparticles of the halogen-releasing precursor solid-dispersed in water.

The photothermographic material according to the present invention is characterized by high sensitivity, high developing speed and little performance fluctuation due to variation of heat development temperature.

PREFERRED EMBODIMENTS OF THE INVENTION

The photothermographic material of the present invention will be explained in detail hereinafter.

The photothermographic material of the present invention comprises at least (a) a photosensitive silver halide, (b) a silver salt of an organic acid, (c) a reducing agent and (d) a hydrophobic and thermoplastic organic binder on a support, and it is characterized by further containing a heat-fusible solvent that is solid at an ordinary temperature and can be fused at a heat development temperature.

Therefore, the heat-fusible solvent used for the photothermographic material of the present invention will be explained first.

The heat-fusible solvent used for the photothermographic material of the present invention is an organic material that is solid at an ordinary temperature but melts or shows a mixed melting point together with other components at a heat development temperature to be used or a temperature lower than that and is liquefied upon heat development to accelerate the heat development. The scope of the heat-fusible solvent includes compounds that can be a solvent for a developing agent, compounds having a high dielectric constant and known to promote physical development of silver salt and so forth.

Preferred examples of the heat-fusible solvent include urea derivatives, amide derivatives, sulfonamide derivatives, polyhydric alcohols and polyethylene glycols.

Specifically, the urea derivatives include urea, dimethylurea, phenylurea, diethyleneurea, diisopropylurea, dimethoxyethylurea, tetramethylurea, tetraethylurea and so forth. The amide derivatives include acetamide, stearylamide, p-toluamide, p-propanoyloxyethoxybenzamide, propionamide, butanamide, benzamide, diacetamide, acetanilide, ethylacetamide acetate, 2-chloropropionamide, phthalimide, succinimide, N,N-dimethylacetamide and so forth. The sulfonamide derivatives include phenylsulfonamide, p-toluenesulfonamide, p-chlorophenylsulfonamide, o-aminophenylsulfonamide, 2-amino-sulfonyl-5-chlorothiophene and so forth. The polyhydric alcohols include 1,6-hexanediol, pentaerythritol, D-sorbitol, dixylitol, 1,4-cyelohexanediol, 2,2'-dihydroxybenzophenone and so forth. As the polyethylene glycols, polyethylene glycols having a molecular weight of 100–100,000 are preferred.

Furthermore, as the heat-fusible solvent that can be used for the present invention, there can be mentioned the compounds disclosed in U.S. Pat. Nos. 3,347,675, 3,667,959, 3,438,776, 3,666,477, Research Disclosure No. 17,643, JP-A-51-19525, JP-A-53-24829, JP-A-53-60223, JP-A-58-118640, JP-A-58-198038, JP-A-59-229556, JP-A-59-68730, JP-A-59-84236, JP-A-60-191251, JP-A-60-232547, JP-A-60-14241, JP-A-61-52643, JP-A-62-78554, JP-A-62-42153, JP-A-62-44737, JP-A-63-53548, JP-A-63-161446, JP-A-1-224751 , JP-A-2-863, JP-A-2-120739 and JP-A-2-123354.

In the present invention, a single kind of the heat-fusible solvent or two or more kinds of the heat-fusible solvents having different melting points may be used together as the heat-fusible solvent. When the heat-fusible solvent is added to a coating solution, it can be dissolved in water or alcohol (methanol, ethanol) and then added to the coating solution. When the heat-fusible solvent is added to an aqueous coating solution and it is insoluble in wafer, it can be made into microparticles (having a mean particle size of preferably 10 $\mu$m or less, more preferably 0.1–5 $\mu$m) by known emulsion dispersion methods or solid dispersion methods, and then added to the coating solution.

In the present invention, the heat-fusible solvent is desirably used in an amount of 5–500 weight %, preferably 10–300 parts by weight per 100 parts by weight of the binder.

In the present invention, the heat-fusible solvent may be contained in various layers constituting the photothermographic material. For example, it can be added to one or more layers of, for example, image-forming layer (photosensitive emulsion layer), intermediate layer, protective layer and undercoat layer. The heat-fusible solvent is melted to exert its effect at the time of the heat development as is understandable from its characteristics, and the melted heat-fusible solvent can diffuse into all of layers to exert its effect during the heat development irrespective of the layer to which the heat-fusible solvent is added. Therefore, when the heat-fusible solvent may affect photosensitivity of the image-forming layer, in particular, when it may adversely affect to promote fluctuation of performance during production and use of the photothermographic material, the heat-fusible solvent is preferably added to a layer other than the image-forming layer (e.g., protective layer, undercoat layer, intermediate layer)

An ultrahigh contrast agent can be used for the photothermographic material of the present invention. While type of the ultrahigh contrast agent that can be used for the present invention is not particularly limited, examples thereof include all of the hydrazine derivatives represented by the formula (H) mentioned in Japanese Patent Application No. 11-87297 (specifically, the hydrazine derivatives mentioned in Tables 1–4 of the same), the hydrazine derivatives described in JP-A-10-10672, JP-A-10-161270, JP-A-10-62898, JP-A-9-304870, JP-A-9-304872, JP-A-9-304871, JP-A-10-31282, U.S. Pat. No. 5,496,695 and EP741,320A.

The substituted alkene derivatives, substituted isoxazole derivatives and particular acetal compounds represented by the formulas (1) to (3) mentioned in Japanese Patent Application No. 11-87297, and more preferably, the cyclic compounds represented by the formula (A) or (B) mentioned in the same, specifically Compounds 1–72 mentioned in Chem. 8 to Chem. 12 of the same, may also be used. Two or more of these ultrahigh contrast agents may be used in combination.

The ultrahigh contrast agent may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, it may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, the ultrahigh contrast agent may be used by dispersing powder of the ultrahigh contrast agent in a suitable solvent such as water using a ball mill, colloid mill, or by means of ultrasonic wave according to a known method for solid dispersion.

While the ultrahigh contrast agent may be added to any layer on the image-forming layer side, it is preferably added to the image-forming layer or a layer adjacent thereto.

The amount of the ultrahigh contrast agent is $1\times10^{-6}$ mole to 1 mole, more preferably from $1\times10^{-5}$ mole to $5\times10^{-1}$ mole, most preferably from $2\times10^{-5}$ mole to $2\times10^{-1}$ mole, per mole of silver.

In addition to these compounds, any of the compounds described in U.S. Pat. Nos. 5,545,515, 5,635,339, 5,654,130 and 5,686,228, International Patent Publication WO97/34196, and JP-A-11-119372, JP-A-11-109546, JP-A-11-119373, JP-A-11-133546, JP-A-11-95365, JP-A-11-95366 and JP-A-11-149136 may also be used.

The silver salt of an organic acid that can be used for the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chain aliphatic carboxylic acid having from 10 to 30, preferably from 15 to 28 carbon atoms, are preferred. Complexes of organic or inorganic acid silver salts of which ligands have a complex stability constant in the range of 4.0–10.0 are also preferred. The silver supplying substance can preferably constitute about 5–70 weight % of the image-forming layer. Preferred examples of the silver salts of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salts of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used for the present invention can be prepared by allowing a solution or suspension of an alkali metal salt (e.g., Na salts, K salts, Li salts) of the aforementioned organic acids to react with silver nitrate. As the preparation method, the method mentioned in Japanese Patent Application No. 11-104187, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method mentioned in Japanese Patent Application No. 11-203413 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in Japanese Patent Application No. 11-115457, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol used for the present invention may be added at any time during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in any amount of 0.01–10 in terms of the weight ratio to water used as a solvent for the preparation of the silver salt of an organic acid, but preferably added in an amount of 0.03–1 in terms of weight ratio to water.

Although shape and size of the organic acid silver salt are not particularly limited, those mentioned in Japanese Patent Application No. 11-104187, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by volume weight average diameter (variation coefficient) is preferably 80% or less, more preferably 50% or less, particularly preferably 30% or less. As a measurement method, for example, the grain size can be determined by irradiating organic acid silver salt dispersed in a liquid with a laser ray and determining an autocorrelation function for change of fluctuation of the scattered light with time (volume weight average diameter). The average grain size determined by this method is preferably from 0.05–10.0 $\mu$m, more preferably from 0.1–5.0 $\mu$m, further preferably from 0.1–2.0 $\mu$m, as in solid microparticle dispersion.

The silver salt of an organic acid used in the present invention is preferably desalted. The desalting method is not particularly limited and any known methods may be used. Known filtration methods such as centrifugal filtration, suction filtration, ultrafiltration and flocculation washing by coagulation may be preferably used. As the method of ultrafiltration, the method mentioned in Japanese Patent Application Nos. 11-115457 can be used.

In the present invention, for obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in Japanese Patent Application No. 11-104187, paragraphs 0027–0038 can be used.

The grain size distribution of the silver salt of an organic acid used in the present invention preferably corresponds to monodispersion. Specifically, the percentage (variation coefficient) of the value obtained by dividing a standard deviation by volume weight average diameter is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of 0.1–5 g/m$^2$, more preferably 1–3 g/m$^2$, in terms of silver.

The photosensitive silver halide used for the present invention is not particularly limited as for the halogen composition, and silver chloride, silver chlorobromide, silver bromide, silver iodobromide, silver chloroiodobromide and so forth may be used. Grain formation of the photosensitive silver halide emulsion may be attained by the method mentioned in JP-A-11-119374, paragraphs 0127–0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those mentioned in JP-A-11-119374, paragraph 0225. Further, the halide composition may have a uniform distribution in the grains, or the composition may change stepwise or continuously in the grains. Silver halide grains having a core/shell structure may also be preferably used. Core/shell grains having preferably a double to quintuple structure, more preferably a double to quadruple structure, may be used. A technique for localizing silver bromide on the surface of silver chloride or silver chlorobromide grains may also be preferably used.

As for the grain size distribution of the silver halide grains used for the present invention, the grains show monodispersion degree of 30% or less, preferably 1–20%, more preferably 5–15%. The monodispersion degree used herein is defined as a percentage (%) of value obtained by dividing standard deviation of grain size by average grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains used for the present invention preferably contain a metal of Group VII or Group VIII in the periodic table of elements or a complex of such a metal. The metal of Group VII or Group VIII of the periodic table or the center metal of the complex is preferably rhodium, rhenium, ruthenium, osmium or iridium. Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The metal or metal complex content is preferably in the range of from $1\times10^{-9}$ to $1\times10^{-3}$ mole, more preferably $1\times10^{-8}$ to $1\times10^{-4}$ mole, per mole of silver. As for specific structures of metal complexes, metal complexes of the structures mentioned in JP-A-7-225449 and so forth can be used. Types and addition methods of these heavy metals and complexes thereof are mentioned in JP-A-11-119374, paragraphs 0227–0240.

The photosensitive silver halide grains may be desalted by washing methods with water known in the art, such as the noodle washing and flocculation washing. However, the grains may not be desalted in the present invention.

The photosensitive silver halide grains are preferably subjected to chemical sensitization. For the chemical sensitization, the method mentioned in JP-A-11-119374, paragraphs 0242–0250 can preferably be used.

Silver halide emulsions used in the present invention may be added with thiosulfonic acid compounds by the method mentioned in EP293917A.

The photosensitive silver halide emulsion used in the present invention is preferably subjected to color sensitization. As a sensitizing dye that can be used for the present invention, there can be advantageously selected those sensitizing dyes that can spectrally sensitize silver halide grains within a desired wavelength range after they are adsorbed by the silver halide grains and have spectral sensitivity suitable for spectral characteristics of the light source to be used for exposure. For example, as dyes that spectrally sensitize in a wavelength range of 550–750 nm, there can be mentioned the compounds of formula (II) mentioned in JP-A-10-186572, and more specifically, dyes of II-6, II-7, II-14, II-15, II-18, II-23 and II-25 mentioned in the same can be exemplified as preferred dyes. As dyes that spectrally sensitize in a wavelength range of 750–1400 nm, there can be mentioned the compounds of formula (I) mentioned in JP-A-11-119374, and more specifically, dyes of (25), (26), (30), (32), (36), (37), (41), (49) and (54) mentioned in the same can be exemplified as preferred dyes. Further, as dyes forming J-band, those disclosed in U.S. Pat. Nos. 5,510,236, 3,871,887 (Example 5), JP-A-2-96131 and JP-A-59-48753 can be exemplified as preferred dyes. These sensitizing dyes can be used each alone, or two or more of them can be used in combination.

The sensitizing dye can be added by the method mentioned in JP-A-11-119374, paragraph 0106. However, the addition method is not particularly limited to that method.

While the amount of the sensitizing dye used in the present invention may be selected to be a desired amount depending on the performance including sensitivity and fog, it is preferably used in an amount of $10^{-6}$–1 mole, more preferably $10^{-4}$–$10^{-1}$ mole, per mole of silver halide in the photosensitive layer.

As gelatin used with the photosensitive silver halide used for the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, modified gelatin such as acid-treated gelatin and phthalized gelatin can also be used.

In the photothermographic material of the present invention, one kind of photosensitive silver halide emulsion may be used or two or more different emulsions (for example, those having different average grain sizes, different halogen compositions, different crystal habits or those subjected to different chemical sensitization conditions) may be used in combination.

The amount of the photosensitive silver halide used in the present invention is preferably from 0.01–0.5 mole, more preferably from 0.02–0.3 mole, particularly preferably from 0.03–0.25 mole, per mole of the silver salt of an organic acid. Methods and conditions for mixing photosensitive silver halide and a silver salt of an organic acid, which are prepared separately, are not particularly limited so long as the effect of the present invention can be attained satisfactorily. Examples thereof include, for example, a method of mixing silver halide grains and a silver salt of an organic acid after completion of respective preparations by using a high-speed stirring machine, ball mill, sand mill, colloid mill, vibrating mill or homogenizer or the like, or a method of preparing a silver salt of an organic acid by mixing a photosensitive silver halide obtained separately at any time during the preparation of the silver salt of an organic acid. In the mixing, two or more kinds of organic acid silver salt aqueous dispersions are preferably mixed with two or more kinds of photosensitive silver salt aqueous dispersions in order to control the photographic properties.

The hydrophobic thermoplastic binder used for the photothermographic material of the present invention will be explained hereinafter.

For the photothermographic material of the present invention, a hydrophobic and thermoplastic organic polymer is preferably used as an organic binder. The term "thermoplastic" used in the present invention have a meaning broader than that of the term used in the field of physics, and means a property of polymer that the polymer can show softened or melted state depending on the characteristics of the polymer when the polymer is heated to a temperature above a certain level. Therefore, although SBR polymer and so forth show rubber elasticity depending on its crosslinking degree, characteristics of such polymers may be included in the scope of the term "thermoplastic" in view of the purpose of the present invention so long as they are softened or melted when heated to a heat development temperature to form a state where transfer and diffusion of substances becomes easy and the development reactions may occur. The same shall apply to other 3-dimensionally crosslinked polymers. The binder used for the present invention consists of a naturally occurring polymer, synthetic polymer or copolymer or other media that can form a film, such as gelatins denatured to be hydrophobic, denatured poly(vinyl alcohols), cellulose acetates, cellulose acetate butyrates, poly(vinylpyrrolidones), poly(vinyl acetates), poly(vinyl chlorides), polyacrylates, poly(methyl methacrylates), copoly(styrene/maleic anhydrides), copoly(styrene/acrylonitriles), copoly(styrene/butadienes), poly(vinyl acetals) (e.g., poly(vinyl formal), poly(vinyl butyral)), poly (esters), poly(urethanes), phenoxy resins, poly(vinylidene chlorides), poly(epoxides), poly(carbonates), poly(vinyl acetates), poly(amides) and so forth. The binder may be formed from water, organic solvent or emulsion by coating it.

As the organic binder used for the present invention, polymer latex is particularly preferred. Polymer latex can be coated without using an organic solvent. Therefore, it favorably does not emit vaporized organic solvent gas into atmosphere during the drying of coated film and it is favorably free from the problem that diffusion of organic solvent gas into environment during the heat development since the organic solvent does not remain in the film. The polymer latex is preferably used in an amount of 50 weight % or more with respect to the total amount of binder. The polymer latex may be used not only in these layers, but also in a back layer. When the photothermographic material of the present invention is used for, in particular, printing use in which dimensional change is critical, the polymer latex should be used also in the back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, micelle dispersion, one in which polymer molecules having a hydrophilic portion are dispersed in a molecular state or the like. Polymer latex used in the present invention is mentioned in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have a mean particle size of about 1–50000 nm, more preferably about 5–1000 nm. The particle size distribution of the dispersed particles is not particularly limited, and the particles may have either wide particle size distribution or monodispersed particle size distribution.

Other than ordinary polymer latex of a uniform structure, the polymer latex used in the present invention may be latex of the so-called core/shell type. In this case, use of different glass transition temperatures of the core and shell may be preferred.

Preferred range of the glass transition temperature (Tg) of the polymer latex used as the binder varies for the protective layer, back layer and organic acid silver salt layer. As for the photosensitive layer or organic acid silver salt layer, the glass transition temperature is 40° C. or lower, preferably −30 to 40° C., for accelerating diffusion of photographic elements during the heat development. Polymer latex used for the protective layer or back layer (in particular, outermost layer) preferably has a glass transition temperature of 25–100° C., because these layers are brought into contact with various apparatuses.

The polymer latex used in the present invention preferably shows a minimum film forming temperature (MFT) of about −30 to 90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins, polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of 5,000 to 1,000,000, preferably from 10,000 to 100,000. Polymers having a too small molecular weight may unfavorably suffer from insufficient mechanical strength of the image-forming layer, and those having a too large molecular weight may unfavorably suffer from bad film forming property.

Examples of the polymer latex used as the organic binder of the photothermographic material of the present invention include latex of methyl methacrylate/ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. Such polymers are also commercially available and examples thereof include acrylic resins such as CEBIAN A4635, 46583, 4601 (all produced by Dicel Kagaku Kogyo Co., Ltd), Nipol Lx811, 814, 821, 820, 857 (all produced by Nippon Zeon Co., Ltd.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30, 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol Lx416, 410, 438C, 2507 (all produced by Nippon Zeon Co., Ltd.); polyvinyl chloride resins such as G351, G576 (both produced by Nippon Zeon Co., Ltd.); polyvinylidene chloride resins such as L502, L513 (both produced by Asahi Chemical Industry Co., Ltd.), ARON D7020, D504, D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

In the present invention, the image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include, in addition to water, water/methanol=90/10, water/methanol=70/30, water/ethanol=90/10, water/isopropanol=90/10, water/dimethylformamide=95/5, water/methanol/dimethylformamide=80/15/5, and water/methanol/dimethylformamide=90/5/5 (the numerals indicate weight %)

In the photothermographic material the present invention, an acid formed by hydration of diphosphorus pentoxide or a salt thereof is preferably used together with the ultrahigh contrast agent. Examples of the acid formed by hydration of diphosphorus pentoxide or a salt thereof include metaphosphoric acid (salt), pyrophosphoric acid (salt), orthophosphoric acid (salt) triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the photosensitive material) depending on the desired performance including sensitivity and fog. However, it can preferably be used in an amount of 0.1–500 $mg/M^2$, more preferably 0.5–100 $mg/m^2$.

The silver halide emulsion and/or the silver salt of an organic acid for use in the photothermographic material of the present invention can be further prevented from the production of additional fog or stabilized against the reduction in sensitivity during the stock storage by a known antifoggant, stabilizer or stabilizer precursor. Examples of suitable antifoggant, stabilizer and stabilizer precursor that can be used individually or in combination include the thiazonium salts described in U.S. Pat. Nos. 2,131,038 and2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The antifoggant that is particularly preferably used in the present invention is a halogen-releasing precursor that can release a halogen by heat or light. Compounds having such a function are organic polyhalogenated compounds having two or more halogen atoms substituted on the same carbon atom, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

Halogen-releasing precursors preferably used for the present invention are those compounds represented by the following formula (H):

(H)

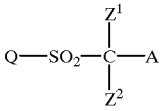

In the formula (H), Q represents an aryl group or a heterocyclic group, both of which may have one or more substituents. $Z^1$ and $Z^2$ each independently represent a halogen atom. A represents a hydrogen atom or an electron-withdrawing group.

The compound represented by the formula (H) will be explained in more detail. In the formula, the aryl group represented by Q is preferably a monocyclic or condensed ring aryl group having 6–30 carbon atoms, preferably a monocyclic or condensed ring aryl group having 6–20 carbon atoms. For example, it may be phenyl group, naphthyl group or the like, particularly preferably phenyl group.

In the formula, the heterocyclic group represented by Q is 3- to 10-membered saturated or unsaturated heterocyclic group containing at least one atom selected from nitrogen (N), oxygen (O) and sulfur (S). The heterocyclic group may be monocyclic or may form a condensed ring with another ring or other rings.

Illustrative examples of the heterocyclic group include thienyl, furyl, pyrrolyl, pyrazolyl, pyridyl, pyrazinyl, pyrimidinyl, pyridazinyl, indolizinyl, isoindolizinyl, 3H-indolyl, indolyl, 1H-indazolyl, purinyl, 4H-quinolizinyl, isoquinolyl, quinolyl, phthalazinyl, naphthyridinyl, quinoxalinyl, quinazolinyl, cinnolinyl, pteridinyl, carbazolyl, β-carbonylyl, phenanthridinyl, acridinyl, perimidinyl, phenanthrolinyl, phenazinyl, phenarsazinyl, phenothiazinyl, furazanyl, phenoxazinyl, isochromanyl, chromanyl, pyrrolidinyl, pyrrolinyl, imidazolidinyl, imidazolinyl, pyrazolidinyl, pyrazolinyl, piperidyl, piperazinyl, indolinyl, isoindolinyl, quinuclidinyl, morpholinyl, triazolyl, tetrazolyl, thiadiazolyl, benzimidazolyl, benzoxazolyl, benzothiazolyl, benzotriazolyl, triazinyl, uracil, triazopyrimidinyl and so forth. Preferably, Q is thienyl, pyridyl, isoquinolyl, quinolyl, triazolyl, benzimidazolyl or benzothiazolyl.

In the formula (H), the aryl group or heterocyclic group represented by Q may have a substituent other than the $—SO_2—C(Z^1)(Z^2)A$ group. Any generally known substituents may be used so long as they do not adversely affect the photographic performance of the photothermographic material of the present invention. Examples of the substituent include, for example, a linear, branched or cyclic alkyl group having preferably 1–20, more preferably 1–12, particularly preferably 1–4 carbon atoms (for example, methyl, ethyl, isopropyl, tert-butyl, n-octyl, tert-amyl, cyclohexyl etc.), an alkenyl group having preferably 2–20, more preferably 2–12, particularly preferably 2–8 carbon atoms (for example, vinyl, allyl, 2-butenyl, 3-pentenyl etc.), an alkynyl group having preferably 2–20, more preferably 2–12, particularly preferably 2–8 carbon atoms (for example, propargyl, 3-pentynyl etc.), an aryl group having preferably 6–30, more preferably 6–20, particularly preferably 6–12 carbon atoms (for example, phenyl, p-methylphenyl, naphthyl etc.), an amino group having preferably 0–20, more preferably 0–10, particularly preferably 0–6 carbon atoms (for example, amino, methylamino, dimethylamino, diethylamino, dibenzylamino etc.), an alkoxy group having preferably 1–20, more preferably 1–12, particularly preferably 1–8 carbon atoms (for example, methoxy, ethoxy, butoxy etc.), an aryloxy group having preferably 6–20, more preferably 6–16, particularly preferably 6–12 carbon atoms (for example, phenyloxy, 2-naphthyloxy etc.), an acyl group having preferably 1–20, more preferably 1–16, particularly preferably 1–12 carbon atoms (for example, acetyl, benzoyl, formyl, pivaloyl etc.), an alkoxycarbonyl group having preferably 2–20, more preferably 2–16, particularly preferably 2–12 carbon atoms (for example, methoxycarbonyl, ethoxycarbonyl etc.), an aryloxycarbonyl group having preferably 7–20, more preferably 7–16, particularly preferably 7–10 carbon atoms (for example, phenoxycarbonyl etc.), an acyloxy group having preferably 1–20, more preferably 2–16, particularly preferably 2–10 carbon atoms (for example, acetoxy, benzoyloxy etc.), an acylamino group having preferably 1–20, more preferably 2–16, particularly preferably 2–10 carbon atoms (for example, acetylamino, benzoylamino etc.), an alkoxycarbonylamino group having preferably 2–20, more preferably 2–16, particularly preferably 2–12 carbon atoms (for example, methoxycarbonylamino etc.), an aryloxycarbonylamino group having preferably 7–20, more preferably 7–16, particularly preferably 7–12 carbon atoms (for example, phenyloxycarbonylamino etc.), a sulfonylamino group having preferably 1–20, more preferably 1–16, particularly preferably 1–12 carbon atoms (for example, methanesulfonylamino, benzenesulfonylamino etc.), a sulfamoyl group having preferably 0–20, more preferably 0–16, particularly preferably 0–12 carbon atoms (for example, sulfamoyl, methylsulfamoyl, dimethylsulfamoyl, phenylsulfamoyl etc.), a carbamoyl group having preferably 0–20, more preferably 0–16, particularly preferably 0–12 carbon atoms (for example, carbamoyl, diethylcarbamoyl, phenylcarbamoyl etc.), a ureido group having preferably 1–20, more preferably 1–16, particularly preferably 1–12 carbon atoms (for example, ureido, methylureido, phenylureido etc.), an alkylthio group having preferably 1–20, more preferably 1–16, particularly preferably 1–12 carbon atoms (for example, methylthio, ethylthio etc.), an arylthio group having preferably 6–20, more preferably 6–16, particularly preferably 6–12 carbon atoms (for example, phenylthio etc.), a sulfonyl group having preferably 1–20, more preferably 1–16, particularly preferably 1–12 carbon atoms (for example, mesyl, benzenesulfonyl, tosyl etc.), a sulfinyl group having preferably 1–20, more preferably 1–16, particularly preferably 1–12 carbon atoms (for example, methanesulfinyl, benzenesulfinyl etc.), a phosphoramide group having preferably 1–20, more preferably 1–16, particularly preferably 1–12 carbon atoms (for example, diethylphosphoramide, phenylphosphoramide etc.), hydroxy group, mercapto group, a halogen atom (for example, fluorine atom, chlorine atom, bromine atom, iodine atom), a cyano group, a sulfo group or a salt thereof, carboxyl group or a salt thereof, a nitro group, a hydroxamic group, a sulfino group, a hydrazino group, a sulfonylthio group, a thiosulfonyl group, a heterocyclic group (for example, imidazolyl, pyridyl, furyl, piperidyl, morpholyl etc.), disulfide group, a polyethyleneoxy group, a quaternary ammonium group and so forth. These substituents may further be substituted.

$Z^1$ and $Z^2$ each independently represent a halogen atom, preferably bromine atom.

A represents a hydrogen atom or an electron-withdrawing group, preferably a hydrogen atom or bromine atom, particularly preferably bromine atom.

These halogen-releasing precursors may be used as a combination of two or more kinds of them. In such a case, a compound represented by the formula (H) may be used in combination with another halogen-releasing precursor other than the halogen-releasing precursor represented by the formula (H)

Specific examples of the halogen-releasing precursor used for the present invention will be shown below. However, the scope of the halogen-releasing precursor that can be used for the present invention is not limited to these compounds.

II-1

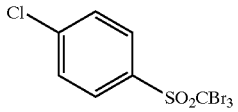

II-2

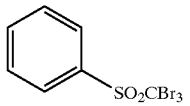

II-3

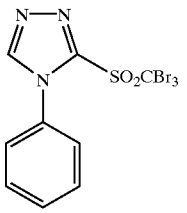

-continued
II-4
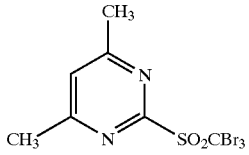
II-5
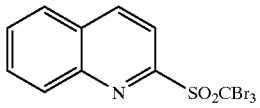
II-6
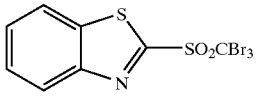
II-7
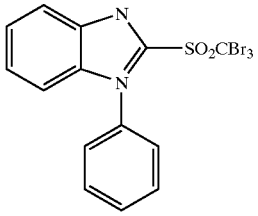
II-8
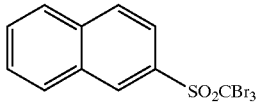
II-9
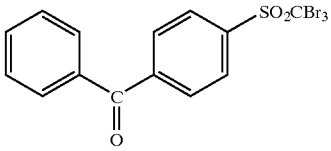
II-10
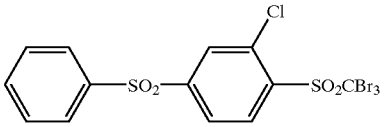
II-11
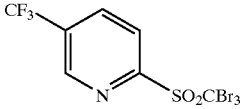
II-12
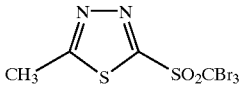
II-13
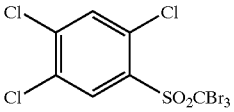
II-14
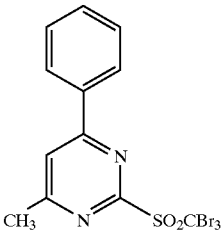
-continued
II-15
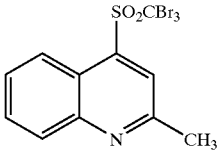
II-16
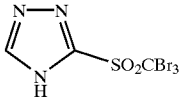
II-17
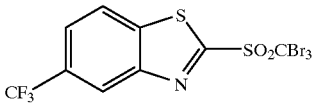
II-18
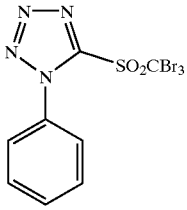
II-19
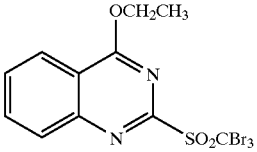
II-20
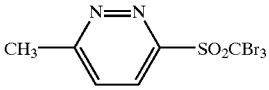
II-21
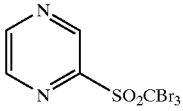
II-22
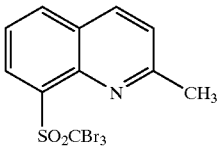
II-23
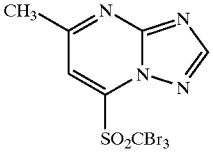
II-24
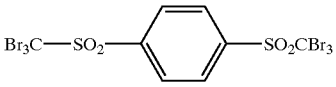
II-25
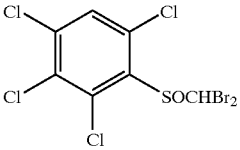

-continued

II-26

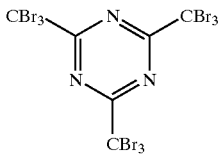

II-27

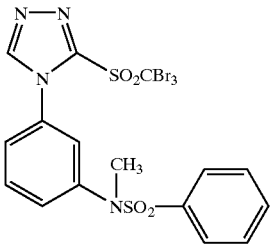

II-28

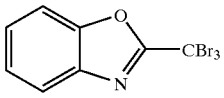

II-29

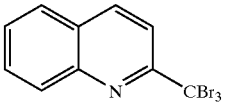

II-30

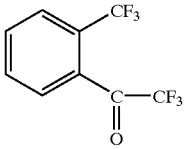

II-31

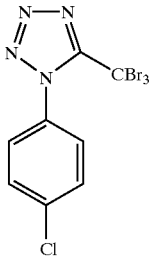

II-32

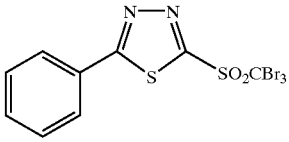

II-33

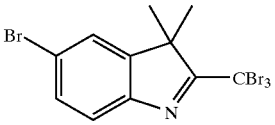

II-34

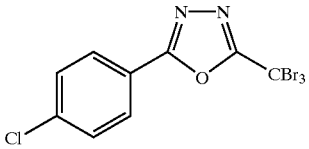

-continued

II-35

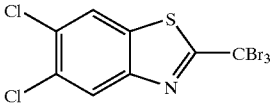

II-36

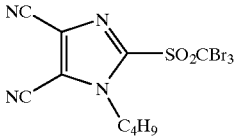

II-37

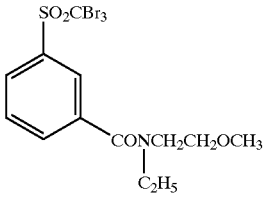

II-38

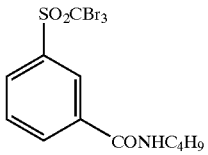

The halogen-releasing precursor used for the present invention may be used in a desired amount for obtaining desired performance such as sensitivity and fog. However, it is preferably used in an amount of $10^{-4}$ to 1 mole, more preferably $10^{-3}$ to $5\times10^{-1}$ mole, per mole of non-photosensitive silver salt in the image-forming layer.

The halogen-releasing precursor used for the present invention may be dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve and added to a coating solution, so that it should be present in films as microcrystals in films after drying. Alternatively, the halogen-releasing precursor may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution, or the halogen-releasing precursor may be added to a coating solution as a fine solid dispersion in a suitable solvent such as water prepared by using a known dispersing machine such as ball mill, colloid mill and sand grinder mill, or a dispersing machine utilizing ultrasonic wave, and dispersion medium such as glass beads, zirconia beads and zircon silicate beads according to a known method for solid dispersion.

The halogen-releasing precursor is particularly preferably added as a solid dispersion. Addition as preliminarily prepared fine solid dispersion is preferred, because it enables addition of the precursor having stably uniform particle size, and thus aggregation thereof in a coating solution or fluctuation of performance can be avoided. In particular, when an aqueous dispersion of thermoplastic resin is used as the binder of the photosensitive image-forming layer, the addition of solid dispersion is most preferred. In this case, the reducing agent is also preferably added as solid dispersion. The halogen-releasing precursor particles in the solid dispersion preferably have a mean particle size of 0.05–5 μm, more preferably 0.1–1 μm. The reducing agent particles in the solid dispersion preferably have a mean particle size of 0.05–5 μm, more preferably 0.1–1 μm.

The halogen-releasing precursor used for the present invention may be used as a combination of two or more kinds of the compound. The halogen-releasing precursor is preferably contained in the photothermographic image-recording layer, intermediate layer or protective layer. It is particularly preferably contained in the image-recording layer.

The photothermographic material of the present invention may optionally contain a compound called "toning agent" in order to improve image density of silver images, color tone of silver and heat developability.

For photothermographic materials using a silver salt of an organic acid, toning agents of a wide range may be used. For example, there can be used those disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis-(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone or 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-isobutylphthalazine, 6-tert-butylphthalazine, 5,7-dimethylphthalazine, 2,3-dihydrophthalazine) and metal salts thereof; combinations of phthalazine or a derivative thereof and a phthalic acid derivative (e.g., phthalic acid, 4-methylphthalic acid, 4-nitrophthalic acid, tetrachlorophthalic acid anhydride, homophthalic acid etc.); quinazolinedione, benzoxazine and naphthoxazine derivatives; rhodium complexes which function not only as a toning agent but also as a halide ion source for the formation of silver halide at the site, such as ammonium hexachlororhodate (III), rhodium bromide, rhodium nitrate and potassium hexachlororhodate (III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione and 6-nitro-1,3-benzoxazin-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene and 1,4-di(o-chlorophenyl)-3,6-dimercapto-1H,4H-2,3a,5,6a-tetraazapentalene and so forth.

These toning agents have been searched in view of desired performances (image density, silver color tone, improvement of heat developability), properties for volatilization, sublimation or the like from photosensitive materials, properties of photosensitive materials comprising them in combination with other additives such as antifoggants and so forth, and many toning agents have been reported. Particularly preferred are phthalazine derivatives represented by the formula (P).

(P)

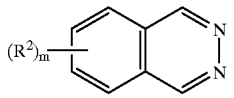

In the formula (P), $R^2$ represents a hydrogen atom or a monovalent substituent. Examples of the substituents represented by $R^2$ include, for example, an alkyl group having preferably from 1–20 carbon atoms, more preferably from 1–12 carbon atoms, further preferably from 1–8 carbon atoms (for example, methyl, ethyl, n-propyl, isopropyl, n-butyl, isobutyl, tert-butyl, n-octyl, n-decyl, n-hexadecyl, cyclopropyl, cyclopentyl, cyclohexyl etc.); an alkenyl group having preferably from 2–20 carbon atoms, more preferably from 2–12 carbon atoms, further preferably from 2–8 carbon atoms (for example, vinyl, allyl, 2-butenyl, 3-pentenyl etc.); an alkynyl group having preferably from 2–20 carbon atoms, more preferably from 2–12 carbon atoms, further preferably from 2–8 carbon atoms (for example, propargyl, 3-pentynyl etc.); an aryl group having preferably from 6–30 carbon atoms, more preferably from 6–20 carbon atoms, further preferably from 6–12 carbon atoms (for example, phenyl, p-methylphenyl, naphthyl etc.); an aralkyl group having preferably from 7–30 carbon atoms, more preferably from 7–20 carbon atoms, further preferably from 7–12 carbon atoms, particularly preferably from 1–8 carbon atoms (for example, benzyl, a-methylmenzyl, 2-phenylethyl, naphthylmethyl, (4-methylphenyl)methyl etc.); an amino group having preferably from 0–20 carbon atoms, more preferably from 0–10 carbon atoms, further preferably from 0–6 carbon atoms (for example, amino, methylamino, dimethylamino, diethylamino, dibenzylamino etc.); an alkoxy group having preferably from 1–20 carbon atoms, more preferably from 1–12 carbon atoms, particularly preferably from 1–8 carbon atoms (for example, methoxy, ethoxy, butoxy etc.); an aryloxy group having preferably from 6–20 carbon atoms, more preferably from 6–16 carbon atoms, further preferably from 6–12 carbon atoms (for example, phenyloxy, 2-naphthyloxy etc.); an acyl group having preferably from 1–20 carbon atoms, more preferably from 1–16 carbon atoms, further preferably from 1–12 carbon atoms (for example, acetyl, benzoyl, formyl, pivaloyl etc.); an alkoxycarbonyl group having preferably from 2–20 carbon atoms, more preferably from 2–16 carbon atoms, further preferably from 2–12 carbon atoms (for example, methoxycarbonyl, ethoxycarbonyl etc.); an aryloxycarbonyl group having preferably from 7–20 carbon atoms, more preferably from 7–16 carbon atoms, further preferably from 7–10 carbon atoms (for example, phenyloxycarbonyl etc.); an acyloxy group having preferably from 2–20 carbon atoms, more preferably from 2–16 carbon atoms, further preferably from 2–10 carbon atoms (for example, acetoxy, benzoyloxy etc.); an acylamino group having preferably from 2–20 carbon atoms, more preferably from 2–16 carbon atoms, further preferably from 2–10 carbon atoms (for example, acetylamino, benzoylamino etc.); an alkoxycarbonylamino group having preferably from 2–20 carbon atoms, more preferably from 2–16 carbon atoms, further preferably from 2–12 carbon atoms (for example, methoxycarbonylamino etc.); an aryloxycarbonylamino group having preferably from 7–20 carbon atoms, more preferably from 7–16 carbon atoms, further preferably from 7–12 carbon atoms (for example, phenyloxycarbonylamino etc.); a sulfonylamino group having preferably from 1–20 carbon atoms, more preferably from 1–16 carbon atoms, further preferably from 1–12 carbon atoms (for example, methanesulfonylamino, benzenesulfonylamino etc.); a sulfamoyl group having preferably from 0–20 carbon atoms, more preferably from 0–16 carbon atoms, further preferably from 0–12 carbon atoms (for example, sulfamoyl, methylsulfamoyl, dimethylsulfamoyl, phenylsulfamoyl etc.); a carbamoyl group having preferably from 1–20 carbon atoms, more preferably from 1–16 carbon atoms, further preferably from 1–12 carbon atoms (for example, carbamoyl, methylcarbamoyl, diethylcarbamoyl, phenylcarbamoyl etc.); an alkylthio group having preferably from 1–20 carbon atoms, more preferably from 1–16 carbon atoms, further preferably from 1–12 carbon atoms (for example, methylthio, ethylthio etc.); an arylthio group having preferably from 6–20 carbon atoms, more preferably from 6–16 carbon atoms, further preferably from 6–12 carbon atoms (for example, phenylthio etc.); a sulfonyl group having preferably from 1–20 carbon atoms, more preferably from 1–16 carbon atoms, further preferably from 1–12 carbon atoms (for example, mesyl, tosyl etc.); a sulfinyl group having preferably from 1–20 carbon atoms, more preferably from 1–16 carbon atoms, further preferably from 1–12 carbon atoms (for example, methanesulfinyl, benzenesulfinyl etc.); a ureido group having preferably from 1–20 carbon atoms, more preferably from 1–16 carbon atoms, further preferably from 1–12 carbon atoms (for example, ureido, methylureido, phenylureido etc.); a phosphoramido group having preferably from 1–20 carbon atoms, more preferably from 1–16 carbon atoms, further preferably from 1–12 carbon atoms (for example, diethylphosphoramido, phenylphosphoramido etc.); a hydroxyl group; a mercapto group; a halogen atom (e.g., fluorine atom, chlorine atom, bromine atom, iodine atom); a cyano group; a sulfo group; a carboxyl group; a nitro group; a hydroxamic acid group; a sulfino group; a hydrazino group; a heterocyclic group (e.g., imidazolyl, pyridyl, furyl, piperidyl, morpholino etc.) and so forth. These substituents may be further substituted with other substituents.

$R^2$is preferably a hydrogen atom, alkyl group, an alkenyl group, an alkynyl group, an aryl group, an aralkyl group, an acyl group, an alkoxycarbonyl group, an aryloxycarbonyl group, an acyloxy group, an acylamino group, an alkoxycarbonylamino group, an aryloxycarbonylamino group, a sulfonylamino group, a sulfamoyl group, a carbamoyl group, a sulfonyl group, a sulfinyl group, hydroxy group, a halogen atom or a cyano group, more preferably a hydrogen atom, an alkyl group, an aryl group, an aralkyl group, an acyl group, a hydroxy group, a halogen atom, or a cyano group, further preferably a hydrogen atom, an alkyl group, an aryl group, an aralkyl group or a halogen atom, particularly preferably a hydrogen atom, an alkyl group, an aryl group or an aralkyl group.

m represents an integer of 1 to 6. m is preferably 3 or less, more preferably 2 or less. (R )m means that 1–6 of $R^2$ independently exist on the phthalazine ring, and when m is 2 or more, adjacent two of $R^2$ may form an aliphatic ring or an aromatic ring. The aliphatic ring is preferably a 3- to 8-membered ring, more preferably 5- or 6-membered ring. The aromatic ring is preferably benzene or naphthalene ring. The aliphatic ring and aromatic ring may be a heterocycle, and it is preferably a 5- or 6-membered ring.

Specific examples of the phthalazine compound represented by the formula (P) are listed below. However, the phthalazine compounds used for the present invention are not limited to these.

I-1

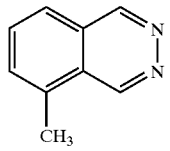

I-2

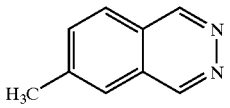

I-3

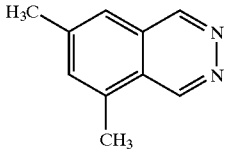

I-4

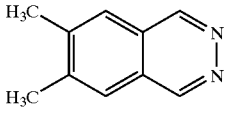

I-5

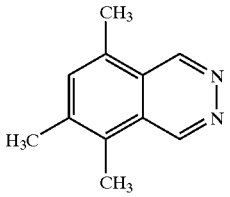

I-6

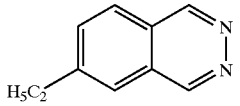

I-7

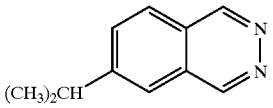

I-8

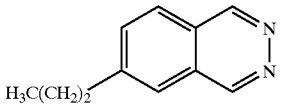

-continued
I-9
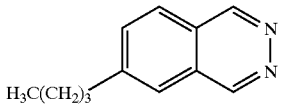
I-10
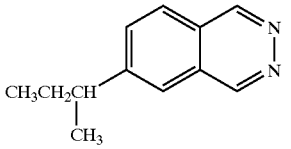
I-11
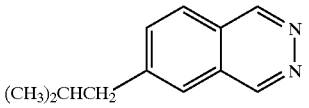
I-12
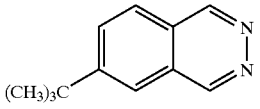
I-13
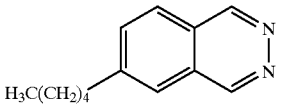
I-14
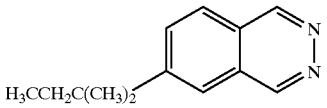
I-15
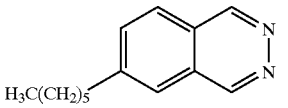
I-16
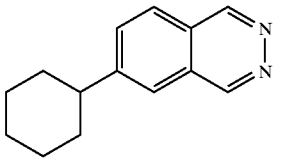
I-17
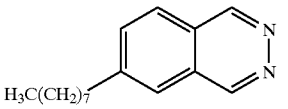
I-18
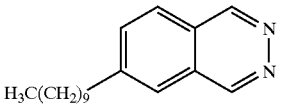
I-19
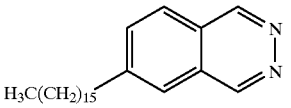
I-20
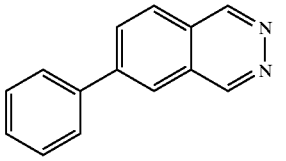
I-21
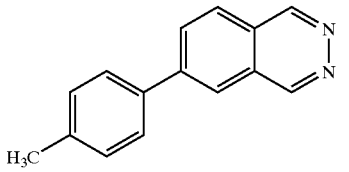
I-22
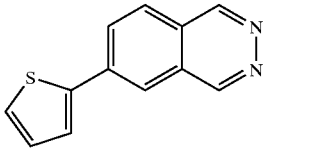
I-23
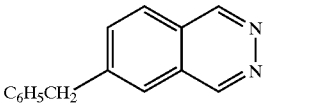
I-24
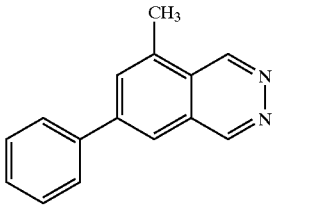
I-25
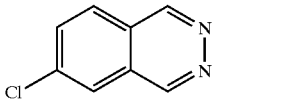
I-26
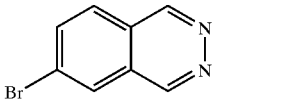
I-27
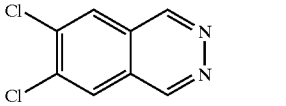
I-28
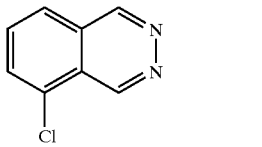
I-29
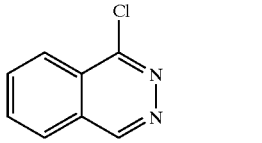
I-30
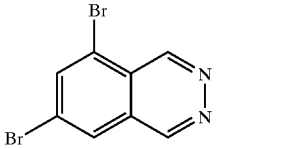

-continued
I-31
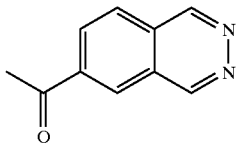
I-32
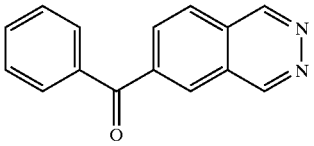
I-33
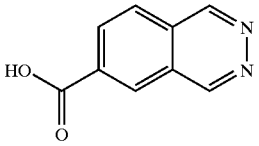
I-34
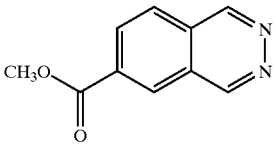
I-35
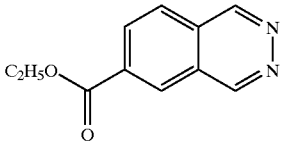
I-36
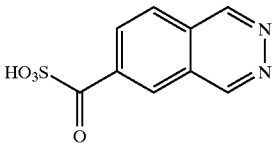
I-37
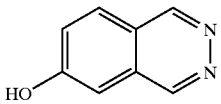
I-38
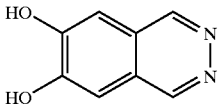
I-39
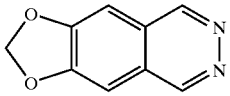
I-40
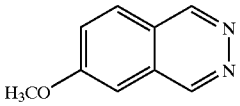
I-41
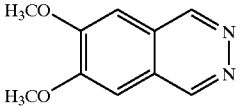
-continued
I-42
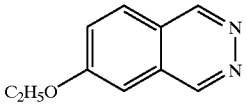
I-43
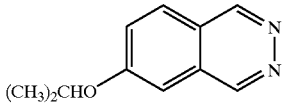
I-44
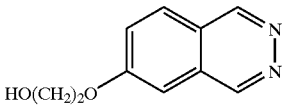
I-45
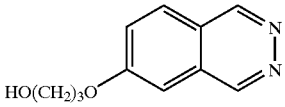
I-46
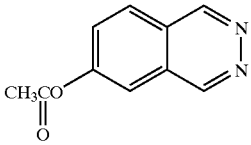
I-47
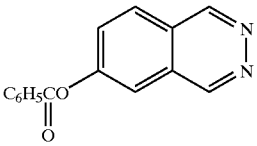
I-48
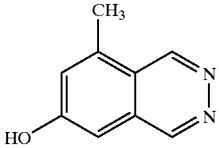
I-49
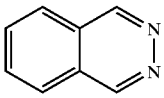
I-50
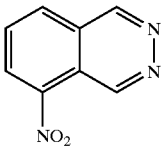
I-51
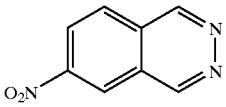
I-52
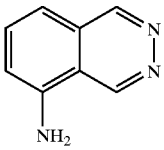
I-53
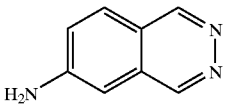

-continued
I-54
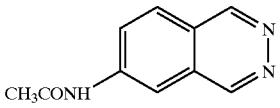
I-55
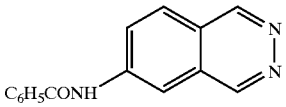
I-56
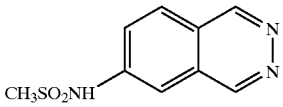
I-57
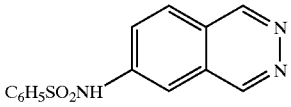
I-58
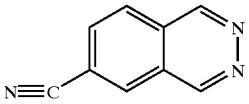
I-59
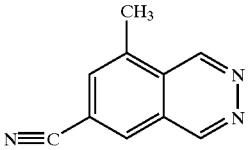
I-60
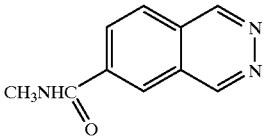
I-61
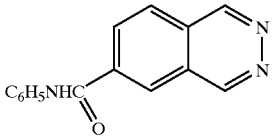
I-62
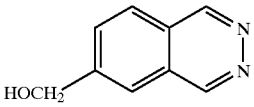
I-63
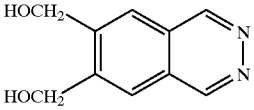
I-64
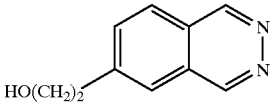
I-65
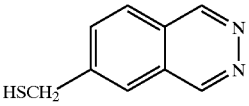
-continued
I-66
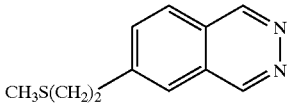
I-67
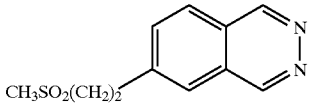
I-68
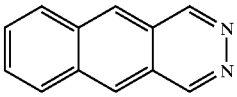
I-69
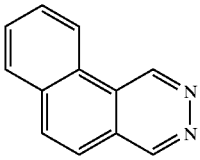
I-70
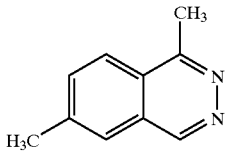
I-71
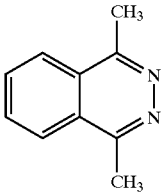
I-72
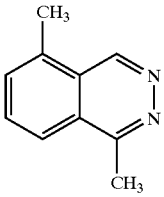
I-73
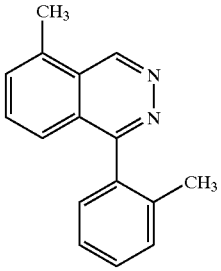

-continued
I-74
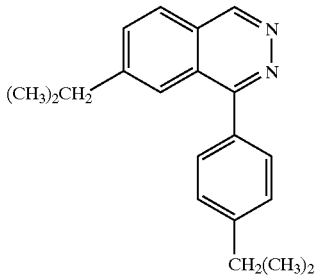
I-75
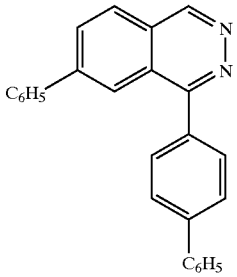
I-76
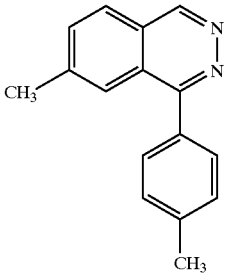
I-77
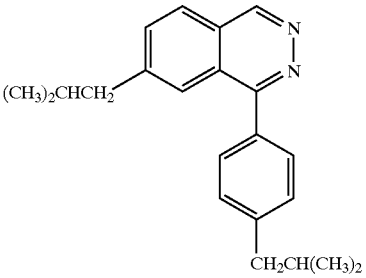
I-78
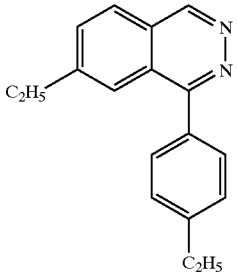
-continued
I-79
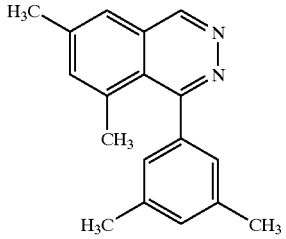
I-80
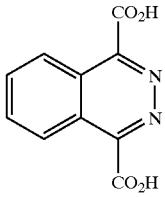
I-81
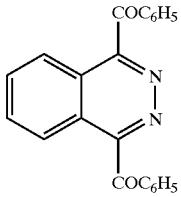
I-82
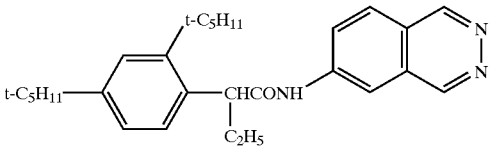
I-83
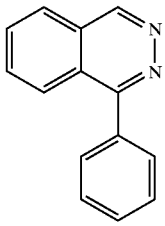
I-84
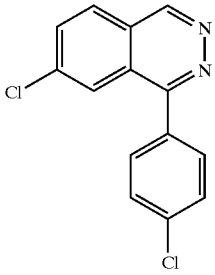
I-85
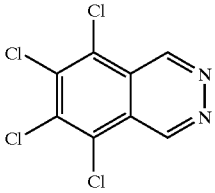

The amount of the phthalazine compound represented by the formula (P) is preferably $10^{-4}$ mole to 1 mole, more preferably $10^{-3}$ mole to 0.3 mole, further preferably $10^{-4}$ mole to 0.3 mole, per mole of silver.

The phthalazine compound represented by the formula (P) may be added in any form, for example, as a solution, powder, solid microparticle dispersion, emulsion, oil-protected dispersion and so forth. The solid microparticle dispersion can be formed by a known pulverization means (for example, a ball mill, vibration ball mill, sand mill, colloid mill, jet mill, roller mill etc.). Further, when solid microparticle dispersion is prepared, a dispersing aid may be used.

The phthalazine compound represented by the formula (P) may be added to any layer on a support provided on the same side as the photosensitive silver halide and the reducible silver salt. However, it is preferably added to a layer containing the silver halide or a layer adjacent thereto.

The photothermographic material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939 and 4,152,160 and JP-A-9-329863, JP-A-9-329864 and JP-A-9-281637.

The benzoic acid compound may be added in any amount. However, the addition amount thereof is preferably from $1\times10^{-6}$ to 2 mole, more preferably from $1\times10^{-3}$ to 0.5 mole, per mole of silver. The benzoic acid compound may be added in any form such as powder, solution, and microparticle dispersion, or it may be added as a solution containing a mixture of the benzoic acid compound with other additives such as a sensitizing dye, reducing agent and toning agent. The benzoic acid compound for use in the present invention may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound for use in the present invention may be added to any site of the photothermographic material, but it is preferably added to a layer on the side of the photosensitive layer that is the image-forming layer (henceforth referred to as "image formation side"), more preferably a layer containing a silver salt of an organic acid.

The photothermographic material of the present invention may contain a mercapto compound, disulfide compound or thione compound so as to control the development by inhibiting or accelerating the development, improve spectral sensitization efficiency or improve the storage stability before or after the development.

In the case of using a mercapto compound, one having any structure may be used but those represented by Ar—$SM^0$ or Ar—S—S—Ar are preferred, wherein $M^0$ is a hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, carbazole, imidazole, oxazole, pyrazole, triazole, thiadiazole, tetrazole, triazine, pyrimidine, pyridazine, pyrazine, pyridine, purine, quinoline and quinazolinone rings. The hetero aromatic ring may have one or more substituents selected from, for example, the group consisting of a halogen (e.g., Br, Cl), a hydroxyl group, an amino group, a carboxyl group, an alkyl group (e.g., those having one or more carbon atoms, preferably from 1 to 4 carbon atoms), an alkoxy group (e.g., those having one or more carbon atoms, preferably from 1 to 4 carbon atoms) and an aryl group (which may have a substituent) Examples of the mercapto-substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole, N-[3-(5-mercaptoacetylamino)propyl] carbazole and so forth. However, compounds that can be used for the present invention are not limited to these.

The amount of the mercapto compound is preferably from 0.0001 to 1.0 mole, more preferably from 0.001 to 0.3 mole, per mole of silver in the image-forming layer.

The image-forming layer (photosensitive layer) of the photothermographic material of the present invention may contain, as a plasticizer or a lubricant, polyhydric alcohols (for example, glycerins and diols described in U.S. Pat. No. 2,960,404), fatty acids or esters thereof described in U.S. Pat. Nos. 2,588,765 and 3,121,060, and silicone resins described in British Patent No. 955,061.

The image-forming layer for use in the photothermographic material of the present invention may contain a dye or a pigment of various types to improve color tone or prevent irradiation. Any dye or pigment may be used, and examples thereof include pigments and dyes described in the color index. Specific examples thereof include organic pigments and inorganic pigments such as pyrazoloazole dyes, anthraquinone dyes, azo dyes, azomethine dyes, oxonol dyes, carbocyanine dyes, styryl dyes, triphenylmethane dyes, indoaniline dyes, indophenol dyes and phthalocyanines. Preferred examples of the dye include anthraquinone dyes (e.g., Compounds 1 to 9 described in JP-A-5-341441, Compounds 3–6 to 3–18 and 3–23 to 3–38 described in JP-A-5-165147), azomethine dyes (e.g., Compounds 17 to 47 described in JP-A-5-341441), indoaniline dyes (e.g., Compounds 11 to 19 described in JP-A-5-289227, Compound 47 described in JP-A-5-341441, Compounds 2–10 and 2–11 described in JP-A-5-165147) and azo dyes (e.g., Compounds 10 to 16 described in JP-A-5-341441).

The amount of the dye or pigment may be determined depending on a desired amount of absorption. In general, the compound is preferably used in an amount of from 1 $\mu$g to 1 g per 1 $m^2$ of the photosensitive material. These dyes may be added in any form, for example, as a solution, emulsion or solid microparticle dispersion, or as a polymer mordant mordanted with a dye.

The photothermographic material of the present invention may have a surface protective layer, for example, in order to prevent adhesion of the image-forming layer.

The surface protective layer may contain any polymer as a binder. The surface protective layer may preferably contain a polymer having carboxyl residues in an amount of from 100 mg/m $^2$ to 5 g/m$^2$. Examples of the polymer having carboxyl residues include, for example, natural polymers (e.g., gelatin, alginic acid), modified natural polymers (e.g., carboxymethyl cellulose, phthalized gelatin), synthetic polymers (e.g., polymethacrylate, polyacrylate, poly(alkyl methacrylate)/acrylate copolymer, polystyrene/polymethacrylate copolymer) and so forth. The content of the carboxyl residue in the polymer is preferably from 10 mmol to 1.4 mol per 100 g of the polymer. The carboxyl residue may form a salt with alkali metal ion, alkaline earth metal ion, organic cation and so forth.

For the surface protective layer, any anti-adhesion material can be used. Examples of the anti-adhesion material include wax, silica particles, styrene-containing elastomeric block copolymer (e.g., styrene/butadiene/styrene, styrene/isoprene/styrene), cellulose acetate, cellulose acetate butyrate, cellulose propionate and mixtures thereof. The surface protective layer may also contain a crosslinking agent for forming cross-linkage or a surface active agent for improving coating property.

In the present invention, the protective layer may contain a light-absorbing material and a filter dye such as those described in U.S. Pat. Nos. 3,253,921, 2,274,782, 2,527,583 and 2,956,879. The dye can be mordanted as described in, for example, U.S. Pat. No. 3,282,699. The filter dye is preferably used in such an amount that absorbance at an exposure wavelength of 0.1–3, most preferably 0.2–1.5, should be achieved.

The photothermographic material of the present invention is preferably a so-called single-sided photosensitive material comprising a support having on one side thereof at least one photosensitive layer (preferably, an image-forming layer) containing a silver halide emulsion and on the other side thereof a back layer.

The back layer preferably has a maximum absorption of from about 0.3 to 2.0 in a desired wavelength range. Where the desired range is 750–1,400 nm, the back layer may preferably have an optical density of 0.005 or more but less than 0.5 at 360–750 nm, and more preferably act as an antihalation layer having optical density of 0.001 or more but less than 0.3. Where the desired range is less than 750 nm, the back layer may preferably be an antihalation layer having a maximum absorption of from 0.3 to 2.0 in the desired range of wavelength before the formation of an image, and an optical density of 0.005 or more but less than 0.3 at 360–750 nm after the formation of an image. The method for decreasing the optical density after the formation of an image to the above-described range is not particularly limited. For example, a method for reducing the density through decoloration of dye by heating as described in Belgian Patent No. 733,706, or a method for reducing the density using decoloration by light irradiation described in JP-A-54-17833 may be used.

When an antihalation dye is used, the dye may be any compound so long as it has an intended absorption in a desired wavelength region and sufficiently low absorption in a visible region after the development, and also provides an absorption spectral pattern desired for the aforementioned back layer. Examples of such a dye include, as a single dye, the compounds described in JP-A-59-56458, JP-A-2-216140, JP-A-7-13295, JP-A-7-11432, U.S. Pat. No. 5,380,635, JP-A-2-68539 (from page 13, left lower column, line 1 to page 14, left lower column, line 9) and JP-A-3-24539 (from page 14, left lower column to page 16, right lower column); and as a dye which is decolored after the treatment, the compounds described in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734 and U.S. Pat. Nos. 4,088,497, 4,283,487, 4,548,896 and 5,187,049. However, the scope of the present invention is not limited to these examples.

The binder suitable for the back layer may be transparent or translucent, and generally colorless. Examples thereof include natural polymers and synthetic resins including homopolymers and copolymers, and other film-forming media. Specific examples include, for example, gelatin, gum arabic, poly(vinyl alcohol), hydroxyethyl cellulose, cellulose acetate, cellulose acetate butyrate, poly(vinylpyrrolidone), casein, starch, poly(acrylic acid), poly(methyl methacrylate), poly(vinyl chloride), poly(methacrylic acid), copoly(styrene/maleic anhydride), copoly(styrene/acrylonitrile), copoly(styrene/butadiene), poly(vinyl acetals) (e.g., poly(vinyl formal), poly(vinyl butyral)), poly(esters), poly(urethanes), phenoxy resin, poly(vinylidene chloride), poly(epoxides), poly(carbonates), poly(vinyl acetate), cellulose esters and poly(amides). The binder may be coated after being dissolved in water or an organic solvent or in the form of an emulsion.

The photothermographic material of the present invention may contain a matting agent in the surface protective layer for the photosensitive emulsion layer (preferably image-forming layer) and/or the back layer or in the surface protective layer for the back layer to improve transferability. The matting agent is, in general, a fine particle of a water-insoluble organic or inorganic compound. Any matting agent may be employed, and those well known in the art may be used, such as organic matting agents described in U S. Pat. Nos. 1,939,213, 2,701,245, 2,322,037, 3,262,782, 3,539,344 and 3,767,448, or inorganic matting agents described in U.S. Pat. Nos. 1,260,772, 2,192,241, 3,257,206, 3,370,951, 3,523,022 and 3,769,020. Specific examples of the organic compound which can be used as the matting agent include, for example, water-dispersible vinyl polymers such as polymethyl acrylate, polymethyl methacrylate, polyacrylonitrile, acrylonitrile/α-methylstyrene copolymer, polystyrene, styrene/divinylbenzene copolymer, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch and urea/formaldehyde/starch reaction product; and gelatin hardened with a known hardening agent and hardened gelatin in the form of a microcapsule hollow particle produced by coacervation hardening. Examples of the inorganic compound include, for example, silicon dioxide, titanium dioxide, magnesium dioxide, aluminum oxide, barium sulfate, calcium carbonate, silver chloride desensitized by a known method, silver bromide desensitized by a known method, glass, diatomaceous earth and so forth. The matting agent may be used as a mixture of different substances as required. The size and shape of the matting agent are not particularly limited and the matting agent may have any particle size. A matting agent having a particle size of from 0.1–30 μm may be preferably used to carry out the present invention. The matting agent may have either a narrow or broad particle size distribution. However, since the matting agent may greatly affect the haze or surface gloss of the photosensitive material, the particle size, shape and particle size distribution are preferably controlled to meet a desired purpose during the preparation of the matting agent or by mixing several matting agents.

The matting agent may preferably be incorporated in the outermost surface layer of the photosensitive material or a layer which functions as the outermost surface layer, or alternatively, in a layer close to the outer surface or a layer which acts as a so-called protective layer. The matting degree on the surface protective layer for the emulsion layer can be freely chosen so long as the star dust troubles do not occur. The degree may preferably be within a range of 500–10,000 seconds, most preferably 500–2,000 seconds, in terms of Beck's smoothness.

According to the present invention, the photothermographic material that is a single-sided photosensitive material and has a back layer containing a matting agent constitutes a preferred embodiment. The matting degree of the back layer is preferably 10–1,200 seconds, more preferably 50–700 seconds, in terms of Beck's smoothness.

The emulsion for photothermography used in the present invention is coated on a support as one or more layers. In the case of a single layer, the layer must contain a silver salt of an organic acid, a silver halide, a developing agent, a binder, and materials to be optionally added such as a color tone adjustor, coating aid and other auxiliary agents. In the case of a double-layer structure, the first emulsion layer (usually a layer adjacent to the substrate) must contain a silver salt of an organic acid and a silver halide, and the second layer or both layers must contain some other components. However, a double-layer structure comprising a single emulsion layer containing all of the components and a protective topcoat may also be contemplated. A multi-color photosensitive photothermographic material may have a combination of the above-described two layers for each of the colors, or as described in U.S. Pat. No. 4,708,928, a structure comprising a single layer containing all components. In the case of a multi-dye multi-color photothermographic material, a functional or non-functional barrier layer is generally provided between respective emulsion layers (photosensitive layers) to keep the emulsion layer away from each other as described in U.S. Pat. No. 4,460,681.

A backside resistive heating layer described in U.S. Pat. Nos. 4,460,681 and 4,374,921 may also be used in the photothermographic image system.

The layers of the photothermographic material of the present invention such as the image-forming layer (photosensitive layer), protective layer and back layer each may contain a hardening agent. Examples of the hardening agent include polyisocyanates described in U.S. Pat. No. 4,281,060, JP-A-6-208193 and so forth, epoxy compounds described in U.S. Pat. Nos. 4,791,042 and so forth, and vinyl sulfone-based compounds described in JP-A-62-89048 and so forth.

In the photothermographic material of the present invention, a surfactant may also be used to improve the coating property, antistatic property and so forth. Examples of the surfactant include nonionic, anionic, cationic and fluorocarbon surfactants, from which the surfactant may be appropriately chosen and used. Specific examples thereof include fluorocarbon polymer surfactants mentioned in JP-A-62-170950, U.S. Pat. No. 5,380,644 and so forth, fluorocarbon surfactants mentioned in JP-A-60-244945, JP-A-63-188135 and so forth, polysiloxane surfactants mentioned in U.S. Pat. No. 3,885,965 and so forth, and polyalkylene oxides and anionic surfactants mentioned in JP-A-6-301140 and so forth.

Various types of supports may be used for the photothermographic material of the present invention. Typical examples of the support include polyester film, undercoated polyester film, poly(ethylene terephthalate) film, polyethylene naphthalate film, nitrocellulose film, cellulose ester film, poly(vinyl acetal) film, polycarbonate film, other related or resinous materials, glass, paper, metal and so forth. A flexible substrate, particularly, a paper support coated with baryta and/or partially acetylated a-olefin polymer, preferably, a polymer of a-olefin having 2–10 carbon atoms, such as polyethylene, polypropylene or ethylene/butene copolymer may typically be used. The support may be either transparent or opaque, and preferably be transparent. Among them, a biaxially stretched polyethylene terephthalate (PET) having a thickness of approximately from 75–200 $\mu$m is particularly preferred.

When a plastic film is passed through a heat development apparatus and processed at 80° C. or higher, the film generally expands or contracts in the dimension. If the processed materials are used as printing plates, such expansion or contraction causes a serious problem at the time of precision multi-color printing. Accordingly, in the present invention, it is preferable to use a film designed to cause little change in the dimension by relaxing the internal strain remaining in the film during the biaxial stretching and thereby eliminating the heat shrinkage distortion that may be generated during the heat development. For example, polyester, in particular, polyethylene terephthalate and so forth, heat-treated at 100–210° C. before a photothermographic emulsion is coated thereon is preferably used. A film having a high glass transition point is also preferred, for example, a film of polyether ethyl ketone, polystyrene, polysulfone, polyether sulfone, polyarylate or polycarbonate may be used.

The photothermographic material of the invention may have, for antistatic purpose, for example, a layer containing soluble salts (e.g., chlorides and nitrates), an deposited metal layer, a layer containing ionic polymers described in U.S. Pat. Nos. 2,861,056 and 3,206,312, insoluble inorganic salts described in U.S. Pat. No. 3,428,451, or tin oxide microparticles described in JP-A-60-252349 and JP-A-57-104931.

As the method for producing color images using the photothermographic material of the invention, there is mentioned the method described in JP-A-7-13295, page 10, left column, line 43 to page 11, left column, line 40. Stabilizers for color dye images are exemplified in British Patent No. 1,326,889, U.S. Pat. Nos. 3,432,300, 3,698,909, 3,574,627, 3,573,050, 3,764,337 and 4,042,394.

In the present invention, the photothermographic emulsion can be coated by various coating methods including dip coating, air knife coating, flow coating, and extrusion coating using a hopper of the type described in U.S. Pat. No. 2,681,294. If desired, two or more layers may be simultaneously coated by the methods described in U.S. Pat. No. 2,761,791 and British Patent No. 837,095.

The photothermographic material of the invention may contain additional layers, for example, a dye accepting layer for accepting a mobile dye image, an opacifying layer when reflection printing is desired, a protective topcoat layer, and a primer layer well known in the field of photothermography. The photosensitive material of the invention is preferably able to form an image by only a single sheet of the photosensitive material. That is, it is preferred that a functional layer necessary to form an image such as an image-receiving layer does not constitute a separate member.

Although the photothermographic material of the invention may be developed by any method, the development is usually performed by heating a photothermographic material exposed imagewise. As preferred embodiments of heat development apparatus to be used, there are heat development apparatuses in which a photothermographic material is brought into contact with a heat source such as heat roller or heat drum as disclosed in JP-B-5-56499, Japanese Patent No. 684453, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. With the photothermographic material of the present invention, good images can be formed even with a relatively low temperature and relatively short development time. The temperature for the development is preferably 80–250° C., more preferably 100–140° C., particularly preferably 100–125° C. The development time is preferably 1–180 seconds, more preferably 10–90 seconds.

As a method for preventing uneven development due to dimensional change of the photothermographic material during the heat development, it is effective to employ a method for forming images wherein the material is heated at a temperature of 80° C. or higher but lower than 115° C. (preferably 113° C. or lower) for 5 seconds or more so as not to develop images, and then subjected to heat development at 110° C. or higher (preferably 130° C. or lower) to form images (so-called multi-step heating method).

The photothermographic material of the present invention can be exposed in any manner. As light source of exposure, laser rays are preferred. As the laser used in the present invention, gas lasers, YAG lasers, dye lasers, semiconductor lasers and so forth are preferred. A combination of semiconductor laser and second harmonic generating device may also be used.

The photothermographic material of the present invention shows low haze at the exposure, and is liable to incur generation of interference fringes. For preventing the generation of interference fringes, a technique of entering a laser ray obliquely with respect to the photothermographic material disclosed in JP-A-5-113548 and a method of using a multimode laser disclosed in WO95/31754 have been known, and these techniques are preferably used.

The photothermographic material of the present invention is preferably exposed such that the laser rays are overlapped and the scanning lines are not viewed as described in *SPIE*, Vol. 169, "Laser Printing", 116, 128 (1979), JP-A-4-51043, WO95/31754 and so forth.

EXAMPLES

The present invention will be further specifically explained with reference to the following examples. The materials, amounts, ratios, type and procedures of treatments and so forth shown in the following examples can be optionally changed so long as such change does not depart from the spirit of the present invention. Therefore, the scope of the present invention should not be construed in a limitative way based on the following examples.

Example 1

<<Preparation of Support Having Undercoat Layers>>

(Preparation of Undercoating Solution A)

In an amount of 1 g of polystyrene microparticles (mean particle size: 0.2 μm) and 20 ml of Surface active agent 1 (1 weight %) were added to 200 ml of polyester copolymer aqueous dispersion (Pesresin A-515GB, Takamatsu Yushi K. K., 30 weight %), and the mixture was further added with distilled water to a volume of 1000 ml to form Undercoating solution A.

(Preparation of Undercoating Solution B)

In an amount of 200 ml of styrene/butadiene copolymer aqueous dispersion (styrene/butadiene/itaconic acid=47/50/3 (weight ratio), concentration: 30 weight %) and 0.1 g of polystyrene microparticles (mean particle size: 2.5 μm) were added to 680 ml of distilled water, and the mixture was further added with distilled water to a volume of 1000 ml to form Undercoating solution B.

(Preparation of Undercoating Solution C)

In an amount of 10 g of inert gelatin was dissolved in 500 ml of distilled water, added with 40 g of aqueous dispersion of tin oxide/antimony oxide composite microparticles disclosed in JP-A-61-20033 (40 weight %), and the mixture was further added with distilled water to a volume of 1000 ml to form Undercoating solution C.

(Preparation of Support Having Undercoat Layers)

A PET film having a thickness of 175 μm was subjected to a corona discharging treatment, and coated with Undercoating solution A by a bar coater in a wet coating amount of 5 ml/m$^2$ and dried at 180° C. for 5 minutes. Then, the back surface thereof was subjected to the corona discharge treatment and then coated with Undercoating solution B by a bar coater in a wet coating amount of 5 ml/m$^2$ so that a dry thickness of about 0.3 μm should be obtained and the coated layer was dried at 180° C. for 5 minutes. This layer was further coated with Undercoating solution C by a bar coater in a wet coating amount of 3 ml/m$^2$ so that a dry thickness of about 0.03 μm should be obtained and the coated layer was dried at 180° C. for 5 minutes to prepare a support having undercoat layers.

<<Preparation of Organic Acid Silver Salt Dispersion>>

To a stirred mixture of 43.8 g of behenic acid (Edenor C22 85R, Henkel Corp.), 730 ml of distilled water and 60 ml of tert-butanol at 79° C., 117 ml of aqueous 1 mole/l NaOH solution was added over 55 minutes, and allowed to react for 240 minutes. Then, the mixture was added with 112.5 ml of aqueous solution containing 19.2 g of silver nitrate over 45 seconds, and left as it was for 20 minutes so that the temperature of the mixture was lowered to 30° C. Thereafter, the solid content was separated by suction filtration, and washed with water until the conductivity of the filtrate became 30 μS/cm. The solid content obtained as described above was not dried but handled as a wet cake. To this wet cake corresponding to 100 g of dry solid content, 7.4 g of polyvinyl alcohol (trade name: PVA205, Kuraray Co., Ltd.) and water were added to make the total amount 385 g, and the resulting mixture was preliminarily dispersed in a homomixer.

Then, the preliminarily dispersed stock dispersion was treated three times in a dispersing machine (trade name: Microfluidizer M-110S-EH, manufactured by Microfluidex International Corporation, using G10Z interaction chamber) under a pressure controlled to be 1,750 kg/cm$^2$ to obtain silver behenate dispersion. The silver behenate particles contained in the silver behenate dispersion obtained as described above were acicular grains having a mean short axis length of 0.04 μm, average long axis length of 0.8 μm and variation coefficient of 30%. The grain size was measured by Master Sizer X manufactured by Malvern Instruments Ltd. During the cooling operation, a desired dispersion temperature was established by providing coiled heat exchangers fixed before and after the interaction chamber and controlling the temperature of the refrigerant.

<<Preparation of Dispersion of Reducing Agent A>>

To 80 g of Reducing agent A and 64 g of 20 weight % aqueous solution of denatured polyvinyl alcohol (Poval MP-203 produced by Kuraray Co., Ltd.), 176 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to prepare reducing agent dispersion. The reducing agent particles contained in the reducing agent dispersion had a mean particle size of 0.45 μm.

<<Preparation of 20 Weight % Dispersion of Mercapto Compound>>

To 64 g of 3-mercapto-4-phenyl-5-heptyl-1,2,4-triazole and 32 g of 20 weight % aqueous solution of denatured polyvinyl alcohol (Poval MP-203 produced by Kuraray Co., Ltd.), 224 g of water was added, and thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 10 hours to obtain mercapto compound dispersion. The mercapto compound particles contained in the mercapto compound dispersion obtained as described above had a mean particle size of 0.67 μm.

<<Preparation of 30 Weight % Dispersion of Organic Polyhalogenated Compound>>

In an amount of 116 g of 2-tribromomethylsulfonylnaphthalene, 48 g of 20 weight % aqueous solution of denatured polyvinyl alcohol (Poval MP203 produced by Kuraray Co., Ltd.) and 224 g of water were thoroughly stirred to obtain slurry. The slurry was introduced into a vessel together with 800 g of zirconia beads having a mean particle size of 0.5 mm, and dispersed in a dispersing machine (¼ G Sand Grinder Mill, manufactured by Imex) for 5 hours to obtain dispersion of organic polyhalogenated compound. The organic polyhalogenated compound particles contained in the dispersion of organic polyhalogenated compound obtained as described above had a mean particle size of 0.74 μm.

<<Preparation of 22 Weight % Dispersion of Compound G>>

In an amount of 10 kg of Compound G and 10 kg of 20 weight % aqueous solution of denatured polyvinyl alcohol (Poval MP203, produced by Kuraray Co. Ltd.) were added with 16 kg of water, and mixed sufficiently to form slurry. The slurry was fed by a diaphragm pump to a sand mill of horizontal type (UVM-2, produced by Imex) containing zirconia beads having a mean particle size of 0.5 mm, and dispersed for 3 hours and 30 minutes. Then, the slurry was added with 0.2 g of benzothiazolinone sodium salt and water so that the concentration of Compound G should become 22 weight % to obtain dispersion. The particles of Compound G contained in the dispersion obtained as described above had a median particle size of 0.55 μm and maximum particle size of 2.0 μm or less. The obtained reducing agent dispersion was filtered through a polypropylene filter having a pore size of 10.0 μm to remove dusts and so forth, and stored.

<<Preparation of Methanol Solution of Phthalazine Compound>>

In an amount of 26 g of 6-isopropylphthalazine as a phthalazine compound was dissolved in 100 ml of methanol and used.

<<Preparation of 20 Weight % Dispersion of Pigment>>

To 64 g of C.I. Pigment Blue 60 and6.4 g of Demor N produced by Kao Corporation, 250 g of water was added, and thoroughly stirred to obtain slurry. The slurry was introduced into a vessel together with 800 g of zirconia beads having a mean particle size of 0. 5 mm, and dispersed in a dispersing machine (¼ G Sand Grinder Mill, manufactured by Imex) for 25 hours to obtain pigment dispersion. The pigment particles contained in the pigment dispersion obtained as described above had a mean particle size of 0.21 μm.

<<Preparation of Silver Halide Grain 1>>

In an amount of 1421 ml of distilled water was added with 6.7 ml of 1 weight % potassium bromide solution, and further added with 8.2 ml of 1 mole/l nitric acid and 21.8 g of phthalized gelatin. Separately, Solution a1 was prepared by adding distilled water to 37.04 g of silver nitrate to dilute it to 159 ml, and Solution b1 was prepared by diluting 32.6 g of potassium bromide with distilled water to a volume of 200 ml. To the aforementioned mixture maintained at 35° C. and stirred in a titanium-coated stainless steel reaction vessel, the whole volume of Solution al was added by the controlled double jet method over 1 minute at a constant flow rate while pAg was maintained at 8.1 (Solution b1 was also added by the controlled double jet method). Then, the mixture was added with 30 ml of 3.5 weight % aqueous hydrogen peroxide solution, and further added with 336 ml of 3 weight % aqueous solution of benzimidazole. Separately, Solution a2 was prepared by diluting Solution a1 with distilled water to a volume of 317.5 ml, and Solution b2 was prepared by dissolving dipotassium hexachloroiridate in Solution b1 in such an amount that its final concentration should become $1\times10^{-4}$ mol per mole of silver, and diluting the obtained solution with distilled water to a volume twice as much as the volume of Solution b1, 400 ml. The whole volume of Solution a2 was added to the mixture again by the controlled double jet method over 10 minutes at a constant flow rate while pAg was maintained at 8.1 (Solution b2 was also added by the controlled double jet method). Then, the mixture was added with 50 ml of 0.5 weight % solution of 2-mercapto-5-methylbenzimidazole in methanol. After pAg was raised to 7.5 with silver nitrate, the mixture was adjusted to pH 3.8 using 0.5 mole/l sulfuric acid, and the stirring was stopped. Then, the mixture was subjected to precipitation, desalting and washing with water, added with 3.5 g of deionized gelatin and 1 mole/l sodium hydroxide to be adjusted to pH 6.0 and pAg of 8.2 to form silver halide dispersion.

The grains in the completed silver halide emulsion were pure silver bromide grains having a mean spherical diameter of 0.031 μm and a variation coefficient of 11% for spherical diameter. The grain size and so forth were obtained from averages for 1000 grains by using an electron microscope. The [100] face ratio of these grains was determined to be 85% by the Kubelka-Munk method.

The aforementioned emulsion was warmed to 50° C. with stirring, added with 5 ml of 0.5 weight % solution of N,N-dihydroxy-N,N-diethylmelamine in methanol and 5 ml of 3.5 weight % solution of phenoxyethanol in methanol, and further added 1 minute later with sodium benzenethiosulfonate in an amount of $3\times10^{-5}$ mole per mole of silver. Further 2 minutes later, the emulsion was added with a solid dispersion of Spectral sensitizing dye 1 (aqueous gelatin solution) in an amount of $5\times10^{-3}$ mole per mole of silver, added further 2 minutes later with a tellurium compound in an amount of $5\times10^{-5}$ mole per mole of silver, and ripened for 50 minutes. Immediately before the completion of the ripening, the emulsion was added with 2-mercapto-5-methylbenzimidazole in an amount of $1\times10^{-3}$ mole per mole of silver, and its temperature was lowered. Thus, chemical sensitization was finished to form Silver halide grain 1.

<<Preparation of Silver Halide Grain 2>>

In 700 ml of water, 22 g of phthalized gelatin and 30 mg of potassium bromide were dissolved, and after adjusting the pH to 5.0 at a temperature of 35° C., 159 ml of aqueous solution containing 18.6 g of silver nitrate and 0.9 g of ammonium nitrate and an aqueous solution containing potassium bromide and potassium iodide at a molar ratio of 92:8 were added by the control double jet method over 10 minutes while pAg was maintained at 7.7. Subsequently, 476 ml of an aqueous solution containing 55.4 g of silver nitrate and 2 g of ammonium nitrate and an aqueous solution containing $1\times10^{-5}$ mole of dipotassium hexachloroiridate and 1 mole of potassium bromide per liter were added by the control double jet method over 30 minutes while pAg was maintained at 7.7, and then 1 g of 4-hydroxy-6-methyl-1,3,3a,7-tetrazaindene was added. Then, pH of the mixture was lowered to cause coagulation precipitation to effect desalting, and the mixture was added with 0.1 g of phenoxyethanol and adjusted to pH 5.9 and pAg of 8.2 to complete the preparation of silver iodobromide grains (cubic grains having a core iodine content of 8 mole %, mean iodine content of 2 mole %, mean grain size of 0.05 μm, variation coefficient of 8% for the projected area, and [100] face ratio of 88%).

The silver halide grains obtained above was warmed to 60° C., added with sodium thiosulfonate in an amount of 85 μmol and 2,3,4,5,6-pentafluorophenyldiphenylphosphine selenide in an amount of $1.1\times10^{-5}$ mole, a tellurium compound in an amount of $1.5\times10^{-5}$ mole, chloroauric acid in an amount of $3.5\times10^{-8}$ mole and thiocyanic acid in an amount of $2.7\times10^{-4}$ mole per mole of silver, ripened for 120 minutes, then quenched to 40° C., added with $1\times10^{-4}$ mole of Spectral sensitizing dye 1 and $5\times10^{-4}$ mole of 2-mercapto-5-methylbenzimidazole, and quenched to 30° C. to obtain Silver halide emulsion 2.

<<SBR Latex Purified by Ultrafiltration>>

The following SBR latex diluted 10 times with distilled water was diluted and purified by using an UF purification module (FS03 FC FUY03A1, Daisen Membrane System Ltd.) until its ionic conductivity became 1.5 mS/cm to obtain SBR latex purified by ultrafiltration. The latex concentration at that time was 40 weight %.

(SBR latex: a latex of -St(68)-Bu(29)-AA(3)-, wherein the numerals in the parentheses indicate the contents in terms of % by weight, St represents styrene, Bu represents butadiene and AA represents acrylic acid)

The latex had the following characteristics: mean particle size of 0.1 μm, concentration of 45 weight %, equilibrated moisture content of 0.6 weight % at 25° C. and relative humidity of 60%, and ion conductivity of 4.2 mS/cm (measured for the latex stock dispersion (40 weight %) at 25° C. by using a conductometer, CM-30S, manufactured by Toa Electronics, Ltd.), pH 8.2.

<<Preparation of Coating Solution for Emulsion Layer>>

In an amount of 103 g of the organic acid silver salt dispersion obtained above and 5 g of 20 weight % aqueous solution of polyvinyl alcohol (PVA205, Kraray Co., Ltd.) were mixed and maintained at 40° C. To this mixture, 35 g of the dispersion of Reducing agent A, 20.3 g of the dispersion of Compound G, 4.8 g of 5 weight % aqueous dispersion of the pigment, C.I. Pigment Blue 60, 10.7 g of the 30 weight % dispersion of organic polyhalogenated compound and 3.1 g of the 20 weight % mercapto compound dispersion were added. Then, the mixture was added with 106 g of 40 weight % SBR latex purified by ultrafiltration and maintained at 40° C., and stirred sufficiently. The mixture was further added with 6 ml of the solution of phthalazine compound in methanol to obtain a mixture containing an organic acid silver salt. Further, 5 g of Silver halide grain 1 and 5 g of Silver halide grain 2 were sufficiently mixed beforehand, mixed with the mixture containing organic acid silver salt by a static mixer immediately before coating to prepare a coating solution for image-forming layer (emulsion layer). This coating solution was fed as it was to a coating die in such a feeding amount that a coated silver amount of 1.2 g/m$^2$ should be obtained.

<<Preparation of Coating Solution for Intermediate Layer for Image Formation Side>>

(Coating Solution for Intermediate Layer)

To 772 g of 10 weight % aqueous solution of polyvinyl alcohol (PVA205, Kuraray Co., Ltd.) and 226 g of 27.5 weight % latex of methyl methacrylate/styrene/2-ethylhexyl acrylate/hydroxyethyl methacrylate/acrylic acid copolymer (copolymerization weight ratio=59/9/26/5/1), 26 ml of 10 weight % aqueous solution of D-sorbitol, which was a heat-fusible solvent satisfying the conditions according to the present invention, 2 ml of 5 weight % aqueous solution of Aerosol OT (American Cyanamid Co.), 4 g of benzyl alcohol, 1 g of 2,2,4-trimethyl-1,3-pentanediol monoisbutyrate and 10 mg of benzisothiazolinone were added to form a coating solution for intermediate layer, which was fed to a coating die at such a feeding rate that its coating amount should be 5 ml/m$^2$.

<<Preparation of Coating Solution for First Protective Layer for Image Formation Side>>

(Coating Solution for First Protective Layer)

In an amount of 80 g of inert gelatin was dissolved in water, added with 138 ml of 10 weight % solution of phthalic acid in methanol, 28 ml of 1 mole/l sulfuric acid, 5 ml of 5 weight % aqueous solution of Aerosol OT (American Cyanamid Co.) and 1 g of phenoxyethanol, and further added with water so that the total amount should become 1000 g to form a coating solution, which was fed to a coating die at such a feeding amount that its coating amount should become 10 ml/m$^2$.

<<Preparation of Coating Solution for Second Protective Layer for Image Formation Side>>

(Coating Solution for Second Protective Layer)

In an amount of 100 g of inert gelatin was dissolved in water, added with 20 ml of 5 weight % solution of N-perfluoro-octylsulfonyl-N-propylalanine potassium salt, 16 ml of 5 weight % solution of Aerosol OT (American Cyanamid Co.), 25 g of polymethyl methacrylate microparticles (average particle size: 4.0 μm), 44 ml of 0.5 mole/l sulfuric acid and 10 mg of benzisothiazolinone, and further added with water to a total amount of 1555 g. The mixture was mixed with 445 ml of an aqueous solution containing 4 weight % of chromium alum and 0.67 weight % of phthalic acid by a static mixer immediately before application and used as a coating solution for surface protective layer. The coating solution was fed to a coating die in such an amount that the coating amount should be 10 ml/m$^2$.

<<Preparation of Coating Solution for Back Surface>>

(Preparation of Base Precursor Solid Microparticle Dispersion)

In an amount of 64 g of base precursor compound and 10 g of surface active agent (Demor N, Kao Corp.) were mixed with 246 ml of distilled water, and the mixture was subjected to bead dispersion in a sand mill (¼ Gallon Sand Grinder Mill, manufactured by Imex) to obtain a solid microparticle dispersion of the base precursor having a mean particle size of 0.2 μm.

(Preparation of Solid Microparticle Dispersion of Dye)

In an amount of 9.6 g of cyanine dye compound and 5.8 g of sodium p-alkylbenzenesulfonate were mixed with 305 ml of distilled water, and the mixture was subjected to bead dispersion in a sand mill (¼ Gallon Sand Grinder Mill, manufactured by Imex) to obtain a solid microparticle dispersion of the dye having a mean particle size of 0.2 $\mu$m.

(Preparation of Coating Solution for Antihalation Layer)

In an amount of 17 g of gelatin, 9.6 g of polyacrylamide, 70 g of the aforementioned solid microparticle dispersion of base precursor, 56 g of the aforementioned solid microparticle dispersion of dye, 1.5 g of polymethyl methacrylate microparticles (average particle size of 6.5 $\mu$m), 2.2 g of sodium polyethylenesulfonate, 0.2 g of 1 weight % aqueous solution of coloring dye compound and 844 ml of water were mixed to prepare a coating solution for antihalation layer.

(Preparation of Coating Solution for Protective Layer)

In a container kept at 40° C., 50 g of gelatin, 0.2 g of sodium polystyrenesulfonate, 2.4 g of N,N-ethylenebis (vinylsulfonacetamide), 1 g of sodium t-octylphenoxyethoxyethanesulfonate, 30 mg of benzisothisazolinone, 32 mg of $C_8F_{17}SO_3K$, 64 mg of $C_8F_{17}SO_2N(C_3H_7)(CH_2CH_2O)_4(CH_2)_4—SO_3Na$ and 950 ml of water were mixed to form a coating solution for protective layer.

The compounds used for Example 1 are shown below.

Spectral sensitizing dye 1

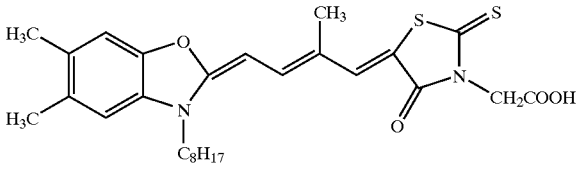

Surface active agent 1

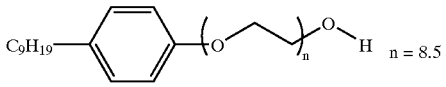

Tellurium compound

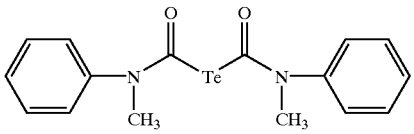

Base precursor compound

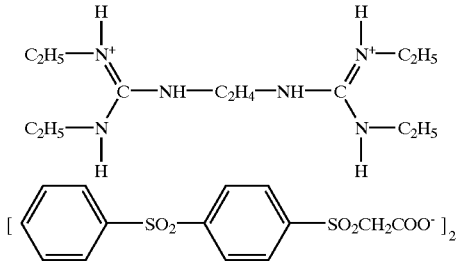

-continued

Cyanine dye compound

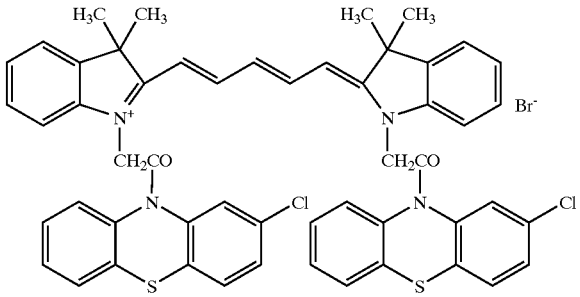

Blue color dye compound

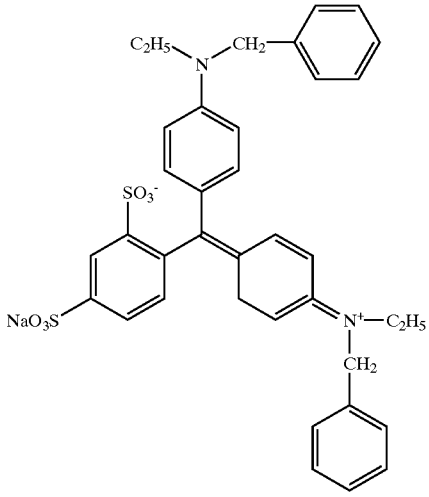

Compound G

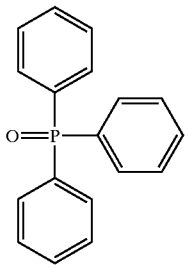

Reducing agent A

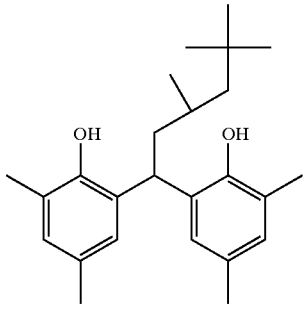

<<Production of Photothermographic Material>>

On the aforementioned support having undercoat layers, the coating solution for antihalation layer and the coating solution for protective layer were simultaneously applied as stacked layers so that the applied solid content amount of the solid microparticle dye in the antihalation layer should become 0.04 g/m$^2$, and the applied amount of gelatin in the protective layer should become 1 g/m$^2$, and dried to form an antihalation back layer. Then, on the surface opposite to the back surface, an image-forming layer, intermediate layer, first protective layer, and second protective layer were simultaneously applied in this order from the undercoat layer by the slide bead coating method as stacked layers to form a photothermographic material (Sample 1 according to the present invention).

Separately, a sample of photothermographic material for comparison was prepared in the same manner except that D-sorbitol was omitted from the intermediate layer on the image formation side (Comparative sample A).

<<Evaluation>>

Each sample of photothermographic material was evaluated as follows.

(Evaluation of Photographic Performance)

Each photosensitive material was light-exposed by a 647 nm Kr laser sensitometer (maximum output: 500 mW) at an angle of 30° with respect to the normal, left in an environment of room temperature and 50% relative humidity for 1 hour, and heat-developed at 119° C. for 10, 15 or 20 seconds. The obtained image was evaluated by a densitometer. The measurement results are evaluated as Dmin (fog) and Dmax. The results are shown in Table 1.

TABLE 1

| | 119° C., 10 sec. | | 119° C., 15 sec. | | 119° C., 20 sec. | |
|---|---|---|---|---|---|---|
| Sample No. | Dmin | Dmax | Dmin | Dmax | Dmin | Dmax |
| A (Comparative) | 0.10 | 0.48 | 0.10 | 1.20 | 0.12 | 1.46 |
| 1 (Invention) | 0.10 | 1.02 | 0.10 | 1.44 | 0.12 | 1.50 |

It was confirmed that images could be rapidly formed by adding a heat-fusible solvent satisfying the conditions according to the present invention. In particular, it was found that a high blackening density could be obtained without increasing fog.

(Evaluation of Storage Stability)

Further, for comparison of storage stability of the photothermographic materials, each unexposed photothermographic material was subjected to a forced aging treatment at 50° C. and 75% relative humidity for 3 days, exposed in the same manner and heat-developed at 119° C. for 15 seconds for Sample 1 of the present invention or at 119° C. for 20 seconds for the comparative sample. Both of the samples did not show substantial difference compared with the cases not utilizing the forced aging treatment, and thus they showed good storage stability.

Example 2

<<Preparation of Undercoated Support>>

A support provided with back layer and heat-treated was prepared as follows.

(Coating of Undercoat Layers)

On one surface of a PET base having a thickness of 120 μm, the following Undercoat layer (a) and Undercoat layer (b) were coated and each dried at 180° C. for 4 minutes.

Undercoat Layer (a)

Polymer latex V-5 (core shell type latex comprising 90% by weight of core and 10% by weight of shell, core: vinylidene chloride/methyl acrylate//methyl methacrylate/acrylonitrile/acrylic acid=93/3/3/0.9/0.1 (weight %), shell; vinylidene chloride/methyl acrylate/methyl methacrylate/acrylonitrile/acrylic acid=88/3/3/3/3 (weight %), weight average molecular weight: 38000) 3.0 g/m$^2$ as solid content

| | |
|---|---|
| 2,4-Dichloro-6-hydroxy-s-triazine | 23 mg/m$^2$ |
| Matting agent (polystyrene, average diameter: 2.4 μm) | 1.5 mg/m$^2$ |
| Undercoat layer (b) | |
| Alkali-treated gelatin ($Ca^{2+}$ content: 30 ppm, jelly strength: 230 g) | 83 mg/m$^2$ |
| Compound A | 1 mg/m$^2$ |
| Compound H | 2 mg/m$^2$ |
| Methyl cellulose | 4 mg/m$^2$ |
| Polyoxyethylene (Emalex 710, Nihon Emulsion Co.) | 3 mg/m$^2$ |

(Coating of Back Layer)

The following back layers were provided on the other side of the PET base.

| | |
|---|---|
| First back layer | |
| Julimer ET-410 (Nihon Junyaku Co., Ltd.) | 38 mg/m$^2$ |
| $SnO_2$/Sb (weight ratio: 9/1, acicular grains, FS-10D, Ishihara Sangyo Kaisha, Ltd.) | 200 mg/m$^2$ |
| Dye A | 20 mg/m$^2$ |
| Matting agent (Polymethyl methacrylate particle, average particle size: 5 μm) | 10 mg/m$^2$ |
| Crosslinking agent (Denacol EX-614B, Nagase Kasei Co., Ltd.) | 13 mg/m$^2$ |
| Second back layer | |
| Latex binder (CHEMIPEARL S-120, Mitsui Petrochemical Industries, Ltd.) | 500 mg/m$^2$ |
| Colloidal silica (Snowtex-C, Nissan Chemical Industries, Ltd.) | 40 mg/m$^2$ |
| Crosslinking agent (Denacol EX-614B, Nagase Kasei Co., Ltd.) | 30 mg/m$^2$ |

Compound A

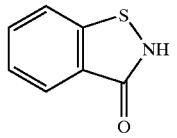

Dye A

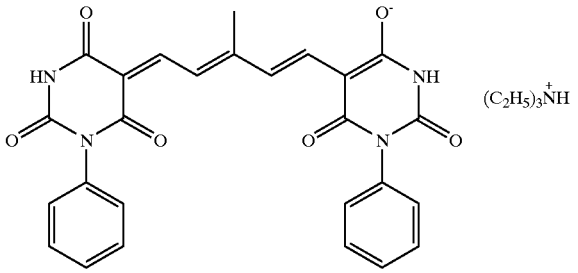

-continued

Compound H

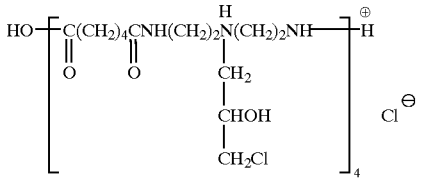

The both back layers were successively applied, and each dried at 180° C. for 4 minutes.

(Heat Treatment of Support)

After the undercoat layers and the back layers were coated and dried, the support was subjected to a first heat treatment at 130° C. for 10 minutes with a tension of 5 kg/cm$^2$, and then a second heat treatment at 40° C. for 15 seconds with a tension of 10 kg/cm$^2$.

<<Preparation of Photosensitive Silver Halide Emulsion A>>

Into 700 ml of water, 11 g of phthalized gelatin, 30 mg of potassium bromide and 10 mg of sodium thiosulfonate were dissolved, and after adjusting the mixture to a temperature of 35° C. and pH of 5.0, 159 ml of an aqueous solution containing 18.6 g of silver nitrate and an aqueous solution containing 1 mole/l of potassium bromide were added by the control double jet method over 6.5 minutes while keeping pAg to be at 7.7. Subsequently, 476 ml of an aqueous solution containing 55.4 g of silver nitrate and an aqueous solution containing 1 mole/l of potassium bromide were added by the control double jet method over 30 minutes while keeping the pAg to be at 7.7, and then 1 g of 4-hydroxy-6-methyl-1,3,3a,7-tetrazaindene was added. Thereafter, the pH was lowered to cause coagulation precipitation to effect desalting, then 0.1 g of phenoxyethanol was added, and the pH and the pAg were adjusted to 5.9 and 8.2, respectively, to complete the preparation of silver bromide grains (cubic grains having an average grain size of 0.12 $\mu$m, coefficient of variation for diameter of projected area of 8%, and (100) face ratio of 88%).

The silver halide grains obtained as described above were warmed to 60° C., added with sodium thiosulfonate in an amount of $8.5\times10^{-4}$ mole per mole of silver, ripened for 120 minutes, quenched to 40° C., added with $1\times10^{-5}$ mole of Sensitizing dye A, $5\times10^{-5}$ mole of Sensitizing dye B, $5\times10^{-5}$ mole of N-methyl-N'-{3-mercaptotetrazolyl}phenyl)urea and 100 ppm of Compound A, and quenched to 30° C. to obtain Silver halide emulsion A.

Sensitizing dye A

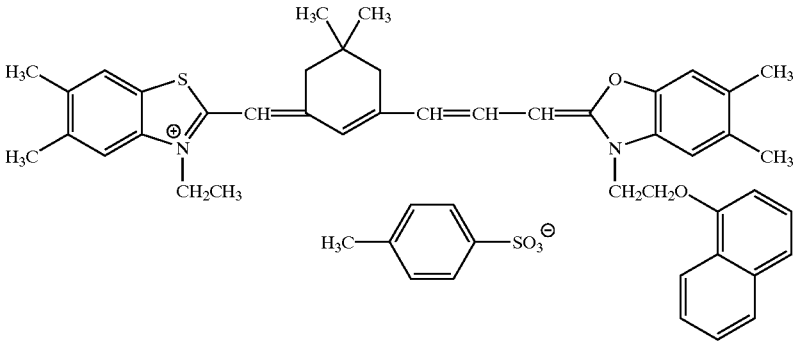

Compound A

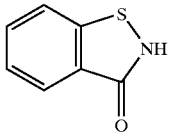

Compound B

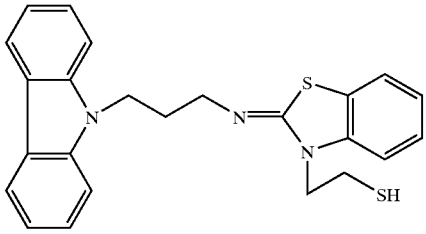

Sensitizing dye B

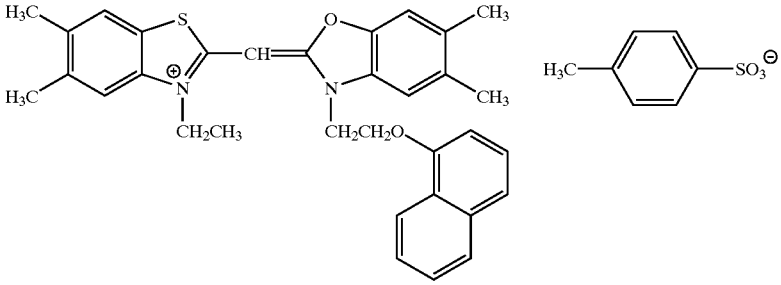

<<Preparation of Organic Acid Silver Salt Dispersion A>>

To 4.4 g of stearic acid, 39.4 g of behenic acid and 770 ml of distilled water, 103 ml of 1 mole/L aqueous NaOH solution was added at 90° C. with stirring, allowed to react for 240 minutes, and cooled to 75° C. Then, 112.5 ml of an aqueous solution containing 19.2 g of silver nitrate was added over 45 seconds to the reaction mixture, which was then left as it was for 20 minutes to be cooled to 30° C. Thereafter, the solid content was separated by suction filtration, and washed with water until the conductivity of the filtrate became 30 μS/cm. The solid content obtained as described above was added with 100 ml of 10 weight % aqueous solution of polyvinyl alcohol, and water of such an amount that the total weight should become 270 g, and roughly dispersed by an automatic mortar. This roughly dispersed organic acid silver salt was further dispersed by a nanomizer (Nanomizer Co., Ltd.) at a pressure of 1000 kg/cm$^3$ upon impact to obtain acicular grain dispersion in which grains had an average short axis length of 0.04 μm, average long axis length of 0.8 μm and variation coefficient of 30%.

<<Preparation of Dispersion of Reducing Agent B>>

To 100 g of Reducing agent B, 100 g of denatured polyvinyl alcohol (Poval MP-203 produced by Kuraray Co., Ltd.), and 2.1 g of sodium triisopropylnaphthalenesulfonate (Leopol BX, Takemoto Oil & Fat Co., Ltd.), 600 g of water was added, and thoroughly stirred to obtain slurry. The slurry was introduced into a vessel together with 840 g of dispersion beads (zirconia particles having a mean particle size of 0.5 mm), and dispersed in a dispersing machine sand mill (¼ G Sand Grinder Mill, manufactured by Imex) for 5 hours to prepare dispersion of Reducing agent B having a mean particle size of 0.4 μm.

Reducing agent B

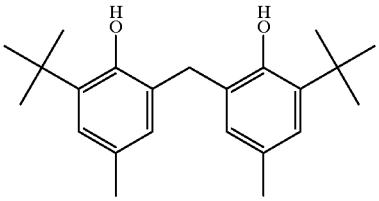

<<Preparation of Solubilized Solution A of Phthalazine Derivative>>

The following components were mixed in the amounts shown below and stirred to obtain Solubilized solution A of Phthalazine derivative A mentioned below.

| | |
|---|---|
| Phthalazine derivative A | 25 g |
| Sodium triisopropylnaphthalenesulfonate (Leopol BX, Takemoto Oil & Fat Co., Ltd.) | 2.1 g |
| Polyvinyl alcohol (PVA-217, produced by Kuraray Co., Ltd., 20% aqueous solution) | 100 g |
| Water | 373 g |

Phthalazine derivative A

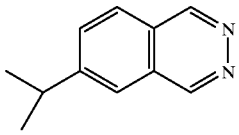

<<Preparation of Solid Microparticle Dispersion of Organic Polyhalogenated Compound>>

To 30 g of Organic polyhalogenated compound A, 0.5 g of hydroxypropylmethyl cellulose, 0.5 g of Compound C and 88.5 g of water were added and sufficiently stirred to form slurry, which was then left for 3 hours. Then, solid microparticle dispersion was prepared in the same manner as that for the preparation of the solid microparticle dispersion of reducing agent. As for particle size, 80 weight % of the particles had a particle size of 0.3–1.0 μm.

Organic polyhalogenated compound A

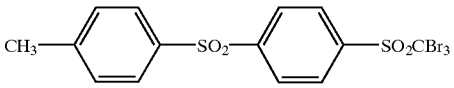

Compound C

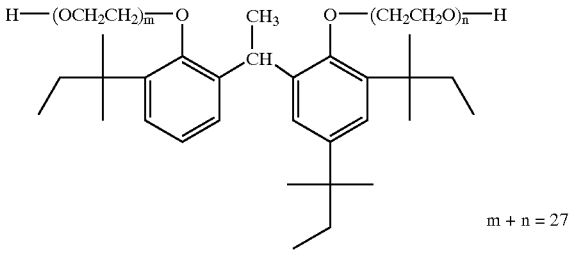

<<Preparation of Dispersion of Salicylic Acid Derivative A>>

In an amount of 210 g of water was added to 30 g of Salicylic acid derivative A, 30 g of denatured polyvinyl alcohol (Poval MP-203 produced by Kuraray Co., Ltd.) and 0.6 g of sodium triisopropylnaphthalenesulfonate (Leopol BX, Takemoto Oil & Fat Co., Ltd.) and mixed sufficiently to form slurry. The slurry was introduced into a vessel together with 960 g of dispersion beads (zirconia particles having a mean particle size of 0.5 mm), and dispersed in a dispersing machine sand mill (¼ G Sand Grinder Mill, manufactured by Imex) for 5 hours. The dispersion was diluted with 105 g of wafer and taken out to obtain dispersion of Salicylic acid derivative A having a mean particle size of 0.4 μm.

Salicylic acid derivative A

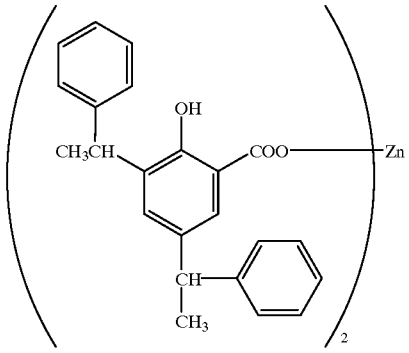

<<Preparation of Dispersion of Ultrahigh Contrast Agent A>>

In an amount of 250 g of water was added to 10 g of Ultrahigh contrast agent A, 10 g of denatured polyvinyl alcohol (Poval MP-203 produced by Kuraray Co., Ltd.) and 0.2 g of sodium triisopropylnaphthalenesulfonate (Leopol BX, Takemoto Oil & Fat Co., Ltd.,) and mixed sufficiently to form slurry. The slurry was introduced into a vessel together with 960 g of dispersion beads (zirconia particles having a mean particle size of 0.5 mm), and dispersed in a dispersing machine sand mill (¼ G Sand Grinder Mill, manufactured by Imex) for 5 hours. The dispersion was diluted with 105 g of water and taken out to obtain dispersion of Ultrahigh contrast agent A having a mean particle size of 0.2 μm.

Ultrahigh contrast agent A

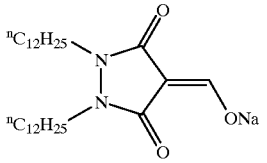

<<Preparation and Coating Solution for Image-forming Layer>>

In an amount of 41 g of the aforementioned organic acid silver salt dispersion, 9.3 g of Photosensitive silver halide emulsion A, 35.5 g of dispersion of Reducing agent B, 2.1 g of dispersion of Salicylic acid derivative A, 21 g of SBR latex (Lacstar #3307B produced by Dainippon Ink & Chemicals, Inc., Tg: 13° C., 49 weight %), 4.9 g of 10 weight % solution of Kuraray Poval MP-203, 5.7 g of Solubilized phthalazine derivative solution A, 4.8 g of the organic polyhalogenated compound dispersion, 3 mg of 5-methylbenzotriazol, 2 mg of Dye A, 2.5 g of dispersion of Ultrahigh contrast agent A and 25 g of water were combined and mixed sufficiently. The coating solution was coated so that the applied silver amount should become 1.0 g/m$^2$.

<<Preparation Coating Solution for Protective Layer>>

In an amount of 109 g of polymer latex containing 27.5% of solid content (copolymer of methyl methacrylate/styrene/2-ethylhexyl acrylate/2-hydroxyethyl methacrylate/methacrylic acid=59/9/26/5/1, glass transition temperature: 55° C.) was added with 7.8 ml of 10 weight % of aqueous solution of succinimide, which was a heat-fusible solvent satisfying the conditions according to the present invention, and 3.75 g of wager, then added with 4.5 g of 2,2,4-trimethyl-1,3-pentanediol-mono(2-methylpropanate) as a film-forming aid, 0.45 g of Compound 2, 0.125 g of Compound 3, 0.0125 mole of Compound 4 and 2.25 g of polyvinyl alcohol (PVA-217 produced by Kuraray Co., Ltd.), and further added with water to an amount of 150 g to form a coating solution. The coating solution was coated on the image-forming layer in such an amount that the amount of coated polymer latex should become 2.0 g/m$^2$.

Compound 2

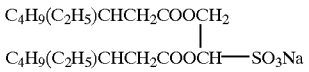

Compound 3

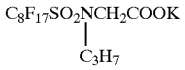

Compound 4

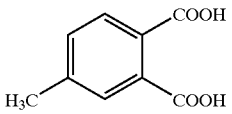

-continued

Dye A

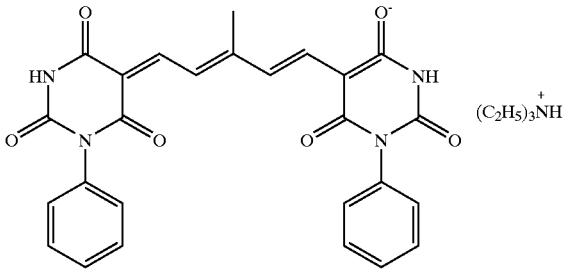

<<Preparation of Photothermographic Material>>

On the side having Undercoat layers (a) and (b) of the aforementioned PET support having back layer and undercoat layers, the coating solution for image-forming layer and the coating solution for protective layer were simultaneously applied as stacked layers. After the coating, the layers were dried at 60° C. for 2 minutes to obtain a sample of photothermographic material (Sample 2 according to the present invention).

Separately, a sample of photothermographic material for comparison was prepared in the same manner except that succinimide was omitted from the coating solution for protective layer (Comparative Sample B).

<<Evaluation>>

(Evaluation of Photographic Performance)

Sample 2 according to the present invention and Comparative Sample B were light-exposed by a xenon flash light of an emission time of $10^{-6}$ seconds through an interference filter having a peak at 780 nm and a step wedge having a density difference of 0.1, left in an environment of room temperature and 50% relative humidity for 1 hour, and heat-developed at 119° C. for 10, 15 or 20 seconds. The obtained image density was measured, and Dmin (fog) and Dmax are shown in Table 2 as in Example 1.

TABLE 2

| | 119° C., 10 sec. | | 119° C., 15 sec. | | 119° C., 20 sec. | |
|---|---|---|---|---|---|---|
| Sample No. | Dmin | Dmax | Dmin | Dmax | Dmin | Dmax |
| B (Comparative) | 0.10 | 0.42 | 0.10 | 2.81 | 0.10 | 3.57 |
| 2 (Invention) | 0.10 | 2.60 | 0.10 | 3.82 | 0.10 | 4.00 |

It was confirmed that the sample according to the present invention could more rapidly form images compared with the comparative sample.

(Evaluation of Storage Stability)

Further, for comparison of storage stability of the photothermographic materials, each unexposed photothermographic material was subjected to a forced aging treatment at 50° C. and 75% relative humidity for 3 days, further left at room temperature and 50% relative humidity for 1 hour, exposed in the same manner and heat-developed at 119° C. for 15 seconds for Sample 2 of the present invention or at 119° C. for 20 seconds for the comparative sample. Both of the samples did not show substantial difference compared with the cases not utilizing the forced aging treatment, and thus they showed good storage stability.

(Evaluation of Development Humidity Dependency)

In general, photographic performance of photothermographic materials fluctuates depending on humidity in an environment for heat development. There is a tendency that the development is retarded at a low humidity, and the development is accelerated at a high humidity. Therefore, it is desirable to make this difference small. The sample of the present invention and the comparative sample were left in an environment of a relative humidity of 10%, 30%, 50% or 70% for 1 hour, exposed in the same environment and heat-developed at 119° C. for 15 seconds for Sample 2 of the present invention or at 119° C. for 20 seconds for the comparative sample. The results are shown in Table 3. Since both of the samples did not show fluctuation for the values of fog, only the values of Dmax are shown in the table.

TABLE 3

| | Relative humidity | | | |
|---|---|---|---|---|
| Sample No. | 10% | 30% | 50% | 70% |
| B (Comparative) | 1.45 | 2.51 | 3.57 | 4.05 |
| 2 (Invention) | 2.70 | 3.20 | 3.82 | 4.10 |

From the data shown in Table 3, it was confirmed that Sample 2 according to the present invention showed a higher Dmax compared with Comparative Sample B at a low humidity, and showed a smaller difference of Dmax values for high humidity and low humidity. This effect obtained by the heat-fusible solvent is a novel finding that cannot be expected at all from previous findings.

Heat-fusible solvents disclosed in JP-A-58-198038, JP-A-58-229556 and others show a peculiar effect only when they are used with a hydrophilic polymer such as gelatin as a binder. These heat-fusible solvents have been considered to act as a plasticizer for the hydrophilic polymer and prevent stiffening of the hydrophilic polymer due to the drop of the water content during the heating for the heat-development whereby diffusion and reaction of the materials contained with the polymer are not inhibited.

Thus, it was reasonably expected that the above effects of the heat-fusible solvents could not be exerted in a system using a hydrophobic thermoplastic polymer as a binder. Sample 2 of the present invention however showed the excellent results unexpectedly.

What is claimed is:

1. A photothermographic material comprising at least (a) a photosensitive silver halide, (b) a silver salt of an organic acid, (c) a reducing agent and (d) a hydrophobic and thermoplastic organic binder on a support; and (e) a heat-fusible solvent that is solid at an ordinary temperature and can be fused at a heat development temperature;

wherein a layer other than the image forming layer contains said heat-fusible solvent and said hydrophobic and thermoplastic organic binder; and the heat-fusible solvent is selected from the group consisting of urea derivatives, amide derivatives, sulfonamide derivatives, polyhydric alcohols and polyethylene glycols.

2. A photothermographic material according to claim 1, wherein the photothermographic material is produced through a step of coating and drying a coating solution containing a latex dispersed in water as the organic binder.

3. A photothermographic material according to claim 1, wherein the photothermographic material further comprises a halogen-releasing precursor.

4. A photothermographic material according to claim 1, wherein the photothermographic material further comprises an ultrahigh contrast agent.

5. A photothermographic material according to claim 1, wherein the photothermographic material is produced through at least one step selected from a step of coating and drying a coating solution containing microparticles of the reducing agent solid-dispersed in water, a step of coating and drying a coating solution containing microparticles of an ultrahigh contrast agent solid-dispersed in water, and a step of coating and drying a coating solution containing microparticles of a halogen-releasing precursor solid-dispersed in water.

6. A photothermographic material according to claim 1, wherein the heat-fusible solvent is urea or a derivative thereof.

7. A photothermographic material according to claim 6, wherein the heat-fusible solvent is selected from the group consisting of urea, dimethylurea, phenylurea, diethyleneurea, diisopropylurea, dimethoxyethylurea, tetramethylurea and tetraethylurea.

8. A photothermographic material according to claim 1, wherein the heat-fusible solvent is an amide derivative.

9. A photothermographic material according to claim 8, wherein the heat-fusible solvent is selected from the group consisting of acetamide, stearylamide, p-toluamide, p-propa-noyloxyethoxybenzamide, propionamide, butanamide, benzamide, diacetamide, acetanilide, ethylacetamide acetate, 2-chloropropionamide, phthalimide, succinimide and N,N-dimethylacetamide.

10. A photothermographic material according to claim 1, wherein the heat-fusible solvent is a sulfonamide derivative.

11. A photothermographic material according to claim 10, wherein the heat-fusible solvent is selected from the group consisting of phenylsulfonamide, p-toluenesulfonamide, p-chlorophenylsulfonamide, o-aminophenylsulfonamide and 2-aminosulfonyl-5-chlorothiophene.

12. A photothermographic material according to claim 1, wherein the heat-fusible solvent is a polyhydric alcohol.

13. A photothermographic material according to claim 12, wherein the heat-fusible solvent is selected from the group consisting of 1,6-hexanediol, pentaerythritol, D-sorbitol, dixylitol, 1,4-cyclohexanediol and 2,2'-dihydroxybenzophenone.

14. A photothermographic material according to claim 1, wherein the heat-fusible solvent is a polyethylene glycol.

15. A photothermographic material according to claim 14, wherein the polyethylene glycol has a molecular weight of 100–100,000.

16. A photothermographic material according to claim 1, wherein the heat-fusible solvent is in an amount of 5–500 parts by weight per 100 parts by weight of the binder.

17. A photothermographic material according to claim 16, wherein the heat-fusible solvent is in an amount of 10–300 parts by weight per 100 parts by weight of the binder.

18. A photothermographic material according to claim 1, wherein the heat-fusible solvent is in an image forming layer.

19. A photothermographic material according to claim 1, wherein the hydrophobic and thermoplastic organic binder is selected from the group consisting of gelatins denatured to be hydrophobic, denatured poly(vinyl alcohols), cellulose acetates, cellulose acetate butyrates, poly(vinylpyrrolidones), poly(vinyl acetates), poly(vinyl chlorides), polyacrylates, poly(methyl methacrylates), copoly(styrene/maleic anhydrides), copoly(styrene/acrylonitriles), copoly(styrene/butadienes), poly(vinyl acetals), poly(esters), poly(urethanes), phenoxy resins, poly(vinylidene chlorides), poly(epoxides), poly(carbonates), poly(vinyl acetates) and poly(amides).

20. A photothermographic material according to claim 1, wherein the heat-fusible solvent is present in at least one of a protective layer, an undercoat layer and an intermediate layer.

21. A photothermographic material according to claim 1, wherein the heat fusible solvent is at least two solvents having different melting points.

22. A photothermographic material according to claim 1, wherein the heat fusible solvent is added as a microparticle having a mean particle size of 10 $\mu$m or less.

* * * * *